US010815633B2

(12) United States Patent
Kruse

(10) Patent No.: US 10,815,633 B2
(45) **Date of Patent: *Oct. 27, 2020**

(54) APPARATUS AND METHODS FOR UNDERGROUND STRUCTURES AND CONSTRUCTION THEREOF

(71) Applicant: Darin R. Kruse, Simi Valley, CA (US)

(72) Inventor: Darin R. Kruse, Simi Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/022,341

(22) Filed: Jun. 28, 2018

(65) Prior Publication Data

US 2018/0305886 A1 Oct. 25, 2018

Related U.S. Application Data

(63) Continuation of application No. 15/089,267, filed on Apr. 1, 2016, now Pat. No. 10,017,910, which is a continuation of application No. 14/252,619, filed on Apr. 14, 2014, now abandoned, which is a continuation of application No. 13/666,505, filed on Nov. 1, 2012, now Pat. No. 8,714,877, which is a continuation of application No. 12/756,944, filed on Apr. 8, 2010, now Pat. No. 8,322,949, which is a continuation of application No. 12/361,425, filed on Jan. 28, 2009, now Pat. No. 7,722,293.

(60) Provisional application No. 61/024,171, filed on Jan. 28, 2008.

(51) Int. Cl.

| | |
|---|---|
| ***E04H 7/18*** | (2006.01) |
| ***E04H 12/12*** | (2006.01) |
| ***E02D 29/045*** | (2006.01) |
| ***E02D 29/055*** | (2006.01) |
| ***E21D 11/08*** | (2006.01) |
| ***E02D 17/04*** | (2006.01) |
| ***E02D 29/02*** | (2006.01) |

(52) U.S. Cl.

CPC ..... *E02D 29/055* (2013.01); *E02D 17/04* (2013.01); *E02D 29/02* (2013.01); *E02D 29/045* (2013.01); *E04H 7/18* (2013.01); *E04H 12/12* (2013.01); *E21D 11/08* (2013.01); *E02D 2600/20* (2013.01)

(58) Field of Classification Search

CPC .... E04H 7/18; E04H 7/20; E04H 7/22; E04H 12/12; E04H 12/16

USPC ..... 52/223.3

See application file for complete search history.

(56) References Cited

U.S. PATENT DOCUMENTS

| | | | |
|---|---|---|---|
| 880,597 | A | 3/1908 | Syze |
| 924,153 | A | 6/1909 | Elliott |
| 1,003,140 | A | 9/1911 | Lardy |
| 1,004,288 | A | 9/1911 | McAlpine |
| 1,089,573 | A | 3/1914 | Morlae |

(Continued)

FOREIGN PATENT DOCUMENTS

| | | |
|---|---|---|
| DE | 2701380 | 7/1978 |
| DE | 19803074 | 8/1999 |

(Continued)

OTHER PUBLICATIONS

Supplementary European Search Report dated Mar. 30, 2015 for European Application No. 12793840.

*Primary Examiner* — Frederick L Lagman

(74) *Attorney, Agent, or Firm* — K&L Gates LLP; Louis C. Cullman; Brian J. Novak

(57) ABSTRACT

Described herein are apparatus, systems and methods useful in forming vertical structures.

21 Claims, 17 Drawing Sheets

(56) References Cited

U.S. PATENT DOCUMENTS

| | | | | | |
|---|---|---|---|---|---|
| 1,275,874 | A | | 8/1918 | Dowell | |
| 1,866,242 | A | | 7/1932 | Warner et al. | |
| 1,889,563 | A | | 11/1932 | O'Rourke | |
| 1,976,628 | A | | 10/1934 | O'Rourke | |
| 2,158,943 | A | | 5/1939 | Mamula | |
| 2,624,193 | A | | 1/1953 | Larson | |
| 2,734,343 | A | | 2/1956 | Asketh | |
| 3,184,893 | A | | 5/1965 | Booth | |
| 3,292,377 | A | | 12/1966 | Sanger | |
| 3,293,865 | A | | 12/1966 | Loofbourow et al. | |
| 3,355,849 | A | | 12/1967 | Lee | |
| 3,516,256 | A | | 6/1970 | Itami et al. | |
| 3,695,044 | A | | 10/1972 | Hoshino et al. | |
| 3,804,260 | A | | 4/1974 | Crowley | |
| 3,820,762 | A | | 6/1974 | Bostrum | |
| 3,854,265 | A | | 12/1974 | Kobayashi et al. | |
| 3,871,183 | A | | 3/1975 | Cardwell et al. | |
| 3,908,387 | A | | 9/1975 | Nakamura | |
| 3,967,451 | A | * | 7/1976 | Garbe | E02D 5/20 405/57 |
| 4,015,383 | A | | 4/1977 | Crowley | |
| 4,050,254 | A | | 9/1977 | Meheen et al. | |
| 4,056,937 | A | | 11/1977 | Suzuki | |
| 4,075,801 | A | | 2/1978 | Alper et al. | |
| 4,178,110 | A | | 12/1979 | Cobbs | |
| 4,205,949 | A | | 6/1980 | Hanson | |
| 4,207,716 | A | | 6/1980 | Moldrup | |
| 4,241,762 | A | | 12/1980 | Link et al. | |
| 4,254,994 | A | | 3/1981 | McBride | |
| 4,270,876 | A | | 6/1981 | Eklund et al. | |
| 4,317,317 | A | * | 3/1982 | Kilts | E04H 7/20 52/223.3 |
| 4,324,081 | A | | 4/1982 | Chicha | |
| 4,401,397 | A | | 8/1983 | Sommer et al. | |
| 4,423,981 | A | | 1/1984 | Nilberg | |
| 4,460,293 | A | | 7/1984 | Richardson et al. | |
| 4,473,322 | A | | 9/1984 | Echols et al. | |
| 4,537,001 | A | | 8/1985 | Uppstrom | |
| 4,812,084 | A | | 3/1989 | Wagner et al. | |
| 4,830,536 | A | | 5/1989 | Birch et al. | |
| 4,913,586 | A | | 4/1990 | Gabbita | |
| 5,029,426 | A | * | 7/1991 | Larson | E04H 7/18 52/745.01 |
| 5,118,230 | A | | 6/1992 | Justice | |
| 5,131,201 | A | * | 7/1992 | Larson | E04H 7/18 52/223.3 |
| 5,141,366 | A | | 8/1992 | Ishida | |
| 5,184,916 | A | | 2/1993 | Thoer | |
| 5,242,246 | A | | 9/1993 | Manchak | |
| 5,261,766 | A | | 11/1993 | Anderson | |
| 5,332,334 | A | | 7/1994 | Wagner et al. | |
| 5,346,332 | A | | 9/1994 | Wagner et al. | |
| 5,474,399 | A | | 12/1995 | Chia-Hsiung | |
| 5,522,676 | A | | 6/1996 | Gryba | |
| 5,544,460 | A | * | 8/1996 | Fife | B65D 88/06 210/532.2 |
| 5,560,172 | A | | 10/1996 | Brophy et al. | |
| 5,590,497 | A | | 1/1997 | Moore | |
| 5,631,160 | A | | 5/1997 | Bruso | |
| 5,639,182 | A | | 6/1997 | Paris | |
| 5,808,052 | A | | 9/1998 | Szablikowski et al. | |
| 5,814,147 | A | | 9/1998 | Tallard | |
| 5,888,023 | A | | 3/1999 | Grabe et al. | |
| 5,944,453 | A | | 8/1999 | Gryba | |
| 5,967,701 | A | | 10/1999 | Berkley et al. | |
| 6,149,352 | A | | 11/2000 | MacDonald | |
| 6,220,789 | B1 | | 4/2001 | White | |
| 6,328,501 | B1 | | 12/2001 | Gimbert | |
| 6,431,798 | B1 | | 8/2002 | Magliocco | |
| 6,485,234 | B2 | | 11/2002 | Johnson | |
| 6,543,963 | B2 | | 4/2003 | Bruso | |
| 6,802,673 | B1 | | 10/2004 | Ellenberger | |
| 7,363,733 | B2 | | 4/2008 | Stoetzer | |
| 7,604,301 | B1 | | 10/2009 | Lang | |
| 7,722,293 | B2 | | 5/2010 | Kruse | |
| 8,176,702 | B2 | | 5/2012 | Adam | |
| 8,322,949 | B2 | | 12/2012 | Kruse | |
| 8,714,877 | B2 | * | 5/2014 | Kruse | E02D 17/04 405/133 |
| 10,017,910 | B2 | * | 7/2018 | Kruse | E02D 17/04 |
| 2002/0012572 | A1 | | 1/2002 | Bruso | |
| 2004/0134144 | A1 | * | 7/2004 | Morrison | E04H 7/18 52/245 |
| 2005/0129504 | A1 | * | 6/2005 | De Roest | E04H 12/085 415/4.2 |
| 2006/0008326 | A1 | | 1/2006 | Landau | |
| 2007/0059108 | A1 | | 3/2007 | Asemdorf | |
| 2007/0264087 | A1 | | 11/2007 | Schmitt | |
| 2008/0008534 | A1 | | 1/2008 | Ille et al. | |
| 2009/0191003 | A1 | | 7/2009 | Kruse | |
| 2010/0154332 | A1 | * | 6/2010 | Shockley | E04C 3/22 52/223.3 |
| 2011/0089745 | A1 | | 4/2011 | Reinhardt | |
| 2012/0301224 | A1 | | 11/2012 | Peters | |
| 2012/0308306 | A1 | | 12/2012 | Kruse | |
| 2013/0078040 | A1 | | 3/2013 | Kruse | |
| 2013/0255112 | A1 | | 10/2013 | Kruse | |
| 2014/0227038 | A1 | | 8/2014 | Kruse | |
| 2015/0275454 | A1 | | 10/2015 | Kruse | |
| 2016/0215472 | A1 | | 7/2016 | Kruse | |
| 2018/0051435 | A1 | | 2/2018 | Kruse | |

FOREIGN PATENT DOCUMENTS

| | | | | | |
|---|---|---|---|---|---|
| EP | 2039881 | A1 | | 3/2009 | |
| EP | 2278075 | A1 | | 1/2011 | |
| FR | 2658228 | | * | 8/1991 | E04H 7/18 |
| FR | 2784706 | A1 | * | 4/2000 | E04B 1/046 |
| GB | 594708 | | | 11/1947 | |
| GB | 711151 | A | * | 6/1954 | E04H 7/18 |
| GB | 721923 | A | * | 1/1955 | E04H 7/18 |
| GB | 750102 | A | | 6/1956 | |
| GB | 1292638 | A | | 10/1972 | |
| GB | 1348765 | A | | 3/1974 | |
| GB | 1508040 | A | | 4/1978 | |
| GB | 2026064 | A | | 1/1980 | |
| GB | 2100772 | A | | 1/1983 | |
| JP | H0819828 | B2 | | 2/1996 | |
| JP | 8-326470 | A | | 12/1996 | |
| JP | H09-296462 | A | | 11/1997 | |
| JP | 10-195911 | A | | 7/1998 | |
| JP | 411081299 | A | | 3/1999 | |
| JP | 2000017651 | A | | 1/2000 | |
| JP | 2010261202 | A | | 11/2010 | |
| WO | WO-8602689 | A1 | * | 5/1986 | E04H 12/12 |
| WO | 1999/018330 | A1 | | 4/1999 | |
| WO | 2001/046526 | | | 6/2001 | |
| WO | 2001/092647 | A1 | | 12/2001 | |
| WO | 2005/052318 | | | 6/2005 | |
| WO | 2009/097355 | | | 8/2009 | |
| WO | 2009/136810 | A1 | | 11/2009 | |
| WO | 2012/167170 | | | 12/2012 | |

* cited by examiner

APPARATUS AND METHODS FOR UNDERGROUND STRUCTURES AND CONSTRUCTION THEREOF

CROSS REFERENCE TO RELATED APPLICATIONS

This application is a continuation of U.S. patent application Ser. No. 15/089,267, filed Apr. 1, 2016, which is a continuation of U.S. patent application Ser. No. 14/252,619, filed Apr. 14, 2014, which is a continuation of U.S. patent application Ser. No. 13/666,505, filed Nov. 1, 2012 now U.S. Pat. No. 8,714,877 issued May 6, 2014, which is a continuation of U.S. patent application Ser. No. 12/756,944, filed Apr. 8, 2010 now U.S. Pat. No. 8,322,949 issued Dec. 4, 2012, which is a continuation of U.S. patent application Ser. No. 12/361,425, filed Jan. 28, 2009 now U.S. Pat. No. 7,722,293 issued May 25, 2010, which claims the benefit of U.S. provisional patent application No. 61/024,171, filed Jan. 28, 2008, the entire disclosures of which are incorporated herein by reference.

FIELD OF INVENTION

The present invention pertains to underground structures and the construction thereof, and more particularly to circular underground structures.

BACKGROUND

Conventional earth shoring systems and construction of permanent subterranean/underground structures evidence a number of limitations and inefficiencies. Previous construction industry methods incorporate a two-step process utilizing temporary lagged solder beams (cantilevered, rakered, or tie back supported), precast concrete (PCC) caissons, sheet piling, soil nailing, plate girders, or incrementally placed reinforced structural shotcrete to restrain the soil during excavation until a permanent structure can be built. Drilling, pile installation, lagging and the pile support system (required for deeper structures) are all temporary facilities/construction that are wasted following the construction of the permanent structure. Optimally, it would be advantageous if an underground structure could be built incorporating the temporary facilities/construction into the permanent structure.

Speaking generally, construction safety regulations and soil mechanics limit the vertical depth that an excavation can achieve without some form of soil support. Therefore, in the present industry, temporary shoring walls are typically erected so that excavation in preparation of underground construction is compliant with soil engineering practice and construction safety standards and laws. Thus, construction of a typical underground structure, such as an underground parking garage, requires that a contractor practically build an underground structure twice: (i) once to temporarily stabilize the excavation site, (e.g. temporary shoring walls), and (ii) a second time to erect the permanent structure.

Unfortunately, other inefficiencies are inherent existing methods, such as additional soil disturbance, excavation, and soil removal requirements allowing room for temporary shoring, which is constructed outside the newly constructed structure. Further, many times, the temporary shoring walls require additional structural support systems or members that physically obstruct or interfere with the permanent structures' construction.

In some existing applications, following the erection of a permanent structure, either part or all of the temporary shoring must be disassembled and removed. Following removal of the temporary shoring, the space between the earth and the permanent structure, now a deep void typically encircling the entire permanent structure, must be filled with additional soil or structural backfill. Other internal supports, as is the case of shoring utilizing rakers, must also be removed and their penetrations through the structure repaired.

As one can appreciate, the above described tasks relating to designing, erecting, dissembling, removing, patching, and back-filling temporary shoring walls command significant additional resources to be expended beyond the cost of erecting a permanent structure, and further compound the complex process of building a permanent underground structure. Further, the above described details require significant amounts of time and manpower to construct any temporary shoring systems which are not used in the permanent structure. This can be equated to significant lost, or wasted time and manpower.

Given the above constraints and problems, a new and efficient manner of constructing underground structures, alleviating the need for temporary shoring structures, would be advantageous. While an underground parking garage presents an exemplary case in point to demonstrate the need for a better solution, this need is felt on a broader level for many other applications requiring a cost effective, structurally sound, efficient underground structure.

SUMMARY

Disclosed herein are underground vertical structures and methods of constructing them which solve a variety of the shortcomings and problems posed by previous methods and structures. Further, embodiments of the present description are capable of mitigating or wholly eliminating such inefficiencies, and further create a permanent, underground structure during the excavation process.

More particularly, embodiments of the present description manifest apparatus, systems and methods comprising an assemblage of precast concrete segments (or panels) that serve as both the temporary earth support needed in the construction and prerequisite excavations required in the construction of such structures, as well as permanent structural components of the underground structures. The structural support consists of a series of horizontally stacked, circular rings, wherein each ring has a plurality of curved segments. The thickness of such segments may vary from about 4 inches to over 16 inches depending on the application. The precast segments are installed end to end forming a complete ring.

Optionally, to complete a given ring, the last segment installed is a key segment, commonly in the shape of a wedge, capable of allowing closure of the ring while accommodating the necessary imperfections in measurement tolerances in the ring itself and compression of the assembled ring (hoop stress) during subsequent pressure grouting. Assembly of the segments in a given ring, including a key segment, provides a better seal between segments, thus eliminating gaps in the joints between adjacent segments. However, if segments are designed to fit a particular circular opening, no key segment need be used.

Additionally, a waterproofing system can be installed adjacent to the soil behind the plurality of segments 102. Components of the waterproofing system include, for example, a dampproofing material 108, a waterproof membrane (not shown) on the back of segments 102 or rubber joint sealants or gaskets between segments 102 can optionally add a further margin of water resistance to underground structure 100 in addition to sealing segments 102 together.

Following the placement of all segments in a ring, grout is applied under pressure to fill the space (void or annulus) between the ring and the face of the excavated soil behind the ring; the grout thereby engages the ring in resisting lateral soil pressure. Without being bound to any particular theory, it is believed that the lateral soil pressure bearing on a given ring applies compressive forces that are carried by hoop stress throughout a ring's structural elements. The resulting friction between the segments in a given ring and the soil resists the gravitational weight of the segments. This resistance enables the next phase of excavation below a completed ring to commence (underpinning) without the use of additional supports to hold up a completed ring. Additional rings can be subsequently constructed below a completed ring (underpinning), and the process is repeated until the predetermined design depth is achieved.

In preferred applications utilizing post-tensioning, both vertical and horizontal post-tensioning ducts provided within the segments are aligned, allowing post-tensioning tendons to be installed and then anchored to the foundation constructed at the designed depth. Post-tensioning is useful for providing integrity to the system (so that it functions as a single structural element rather than as independent rings), for providing three-dimensional resistance to lateral pressures, for anchoring above-grade construction to the present systems and their foundations, and for aiding during construction of the structure. Post tensioning cables, specifically vertical post tensioning cables, are temporarily attached to a segment being lifted into place and tensioning jacks raise the segment into place like a crane lifting a load. This use of post tensioning cables frees up vital machinery that would otherwise be used to finally place a segment. This freeing up of vital machinery aids in efficient use of time and resources on a construction site.

Preferred embodiments of the present description comprise conventional continuous exterior wall footings at the bottom of the lowest ring, further incorporating post-tension anchors with cables that are threaded vertically through conduits in the precast segments. Such post-tension cables are then secured to the top structural deck or top ring of the underground structure.

Once the outside structure is complete, an interior support structure or conventional structural system of horizontal slabs can be constructed. Preferably, the underground structure can be provisioned for dry interior space typically requiring low permeability concrete, gaskets, and the use of any number of waterproofing, dampproofing, drainage, water impermeable grouting and pumping. Further, lifting imbeds, suitably detailed joints and joint gasketing, and possibly bolts between segments provide further panel handling, attachment, and water resistance functions.

According to one aspect of the present description, precast concrete segments are installed end to end to form a circular ring of a depth of about 5 ft to about 6 ft that will serve as the exterior portion of the permanent ring shaped underground structure. The excavation of earth and construction of such rings commences at the surface, and continues one ring at a time (beneath existing rings) until reaching a predetermined depth.

According to yet another aspect of the present description, a method of excavation and erection of the above-described segments and rings is described, including considerations of design of such segments, rings and structures in light of varying earth conditions. Generally speaking, individual segments are placed around the circumference of the excavation forming a complete ring, grout is then placed in the space (void or annulus behind the ring) under pressure, thereby reestablishing contact with earth which is now supported by the completed ring, and then excavation proceeds below the completed ring (underpinning) beginning the construction of the next ring. Once desired depths are achieved (by completion of the required number of rings), conventional, possibly continuous, exterior wall footings are then constructed below the rings, which can optionally incorporate post-tensioning anchors with tendons that are threaded vertically through conduits previously located within the segments. The tendons are then stressed and anchored into the top ring or podium (structural deck) located above the rings, or continued into the above-grade structure. Further, horizontal post tensioning cables can be used to help in fitting segments into their final position and to provide partial tension prior to grouting a completed ring Embodiments of the present description provide both temporary excavation shoring and permanent perimeter structural walls in underground structures in a single process. It is noted that embodiments of the present description mitigate or wholly eliminate the duplication of labor and expense associated with conventional industry practice, (either temporary shoring or precast concrete (PCC) caissons to restrain the soil during excavation until the permanent underground structure is completed). Drilling, pile installation, lagging and the pile support system (required for deeper structures) are all temporary facilities/construction that are wasted following the construction of the underground structure. The circular geometry of embodiments of the present description, when used in combination with horizontal slabs, provides an efficient design for the permanent resistance of earth pressures. Embodiments of the present description used for underground parking also benefit from the unique circular design providing more efficient access and layout for parking.

It is understood that while an underground parking structure as described herein serves as an exemplary application used to describe specific details of a best mode, the present disclosure also contemplates other underground structures used in mining, rail systems, storage facilities, housing, commercial establishments, power facilities, utility pump stations, civil defense shelters, and other subterranean structures.

In one embodiment described herein are methods of constructing an underground vertical structure comprising the steps of: a) excavating soil to a sufficient depth to create a circular void to accommodate a plurality of segments; b) assembling a ring shaped structure comprising the plurality of segments; c) connecting the outside surface of the ring shaped structure with the soil in the circular void, thereby securing the ring shaped structure to the soil; d) excavating earth beneath the ring shaped structure to accommodate a second ring shaped structure; e) repeating steps b-d thereby forming one or more additional ring shaped structures downward into the earth below already formed ring shaped structures until a predetermined depth is reached; and f) forming the underground vertical structure.

In another embodiment of the methods, the connecting step comprises applying a grouting material between the outside surface of the ring shaped structure with the soil in the circular void. In yet another embodiment the grouting material is applied under high pressure.

In still another embodiment, the methods further comprise the step of providing a barrier that prevents moisture from entering the underground structure. In another embodiment, the barrier comprises a waterproofing system having a dampproofing material, one ore more joint gaskets and membranes coated on the plurality of segments.

In another embodiment, the sufficient depth is between about 5 ft and about 6 ft. In yet another embodiment, the sufficient depth is about 5 ft. In still further embodiments, the plurality of segments comprises more than one prefabricated concrete segment.

In another embodiment, the method further comprises adding one or more horizontal support members to the underground structure. In yet another embodiment, the one or more horizontal support members comprise floors in the underground structure. In still another embodiment, the one or more horizontal support members comprise bolts attaching the plurality of segments to one another.

In another embodiment, the method further comprises adding one or more vertical support members to the underground structure. In yet a further embodiment, the one or more vertical support member comprises columns supporting the floors in the underground structure.

In one embodiment described herein is a system for creating an underground structure comprising: a plurality of segments used to fabricate one or more horizontal rings stacked vertically within an area of excavated earth; one or more materials to occupy the void between said vertically stacked horizontal rings; one or more materials used to prevent moisture from entering said underground structure; and one or more materials to occupy an area between said one or more horizontal rings stacked vertically and said area of excavated earth.

In another embodiment, the system further comprises one or more devices to hold together the plurality of segments within a horizontal ring. In further embodiments, the system further comprises one or more vertical support members. In yet further embodiments, the system further comprising one or more horizontal support members.

In another embodiment, the one or more horizontal rings comprise one or more key segments within said plurality of segments used to construct said one or more horizontal rings. In yet another embodiment, the plurality of segments comprise prefabricated concrete segments.

In one embodiment described herein method is described of constructing an underground vertical structure, comprising the steps of: a) excavating soil to a sufficient depth to create a circular void to accommodate a plurality of segments; b) lining said circular void with at least one material that prevents moisture from entering said underground vertical structure; c) assembling a ring shaped structure comprising said plurality of segments; d) connecting the outside surface of said ring shaped structure with said soil in said circular void using a high pressure grouting material, thereby securing said ring shaped structure to said soil; e) excavating earth beneath said ring shaped structure to accommodate a second ring shaped structure; f) repeating steps b-e thereby forming one or more additional ring shaped structures downward into the earth below already formed ring shaped structures until a predetermined depth is reached; g) constructing one or more horizontal support members within said underground vertical structure; and h) forming said underground vertical structure.

BRIEF DESCRIPTION OF THE DRAWINGS

Embodiments of the present description are illustrated by way of example, and not by way of limitation, in the figures of the accompanying drawings and in which like reference numerals refer to similar elements, wherein.

DETAILED DESCRIPTION

In the following description, for the purposes of explanation, specific details are set forth in order to provide a thorough understanding thereof. However, it will be apparent that the description may be practiced without these specific details. In other instances, well-known structures and devices may be depicted in block diagram form or simplified form in order to avoid unnecessary obscuring of the description. Section titles and references appearing within the following paragraphs are intended for the convenience of the reader and should not be interpreted to restrict the scope of the information presented at any given location.

Various aspects and features of the methods, systems, and apparatus are described in more detail hereinafter in the following sections: (i) Functional Overview, (ii) Pre-Manufactured Segments, (iii) Construction and Design Considerations and Methods of Making, (vi) Conclusion and (vii) Examples.

(I) Functional Overview

The capacity (within property lines) of permanent underground vertical structures is limited by the achievable depth and constructability of the selected temporary shoring system required to carry out the construction of the new facility. Many factors affect the viability of a shoring system and its application to a particular site. Achievable depths are constrained by soil type, presence of ground water, earth and other load factors (building surcharges, vehicle loading, etc.) and the structural capacity of the shoring to safely resist these loads. Physical site, economic, offsite encroachment, and structural constraints often limit shoring depths thus limiting the underground structure's capacity. Embodiments of the present description's unique physical form and construction methods minimize the impacts of these constraints.

As illustrated in FIGS. 1-7, generally speaking, embodiments described herein utilize one or more segments 102 (e.g. precast concrete) that are installed end to end to form a circular ring (not fully illustrated), or plurality of segments, that will serve as a portion of a permanent underground vertical structure or shaft, underground structure 100. The excavation of earth and construction of segments 102, into one or more horizontally stacked rings begins at the surface and continues downward one ring at a time, (beneath existing rings), until reaching a desired, predetermined depth of underground structure 100. In this way, no temporary shoring walls are erected, no temporary shoring structural members or appurtenances impede or obstruct construction of the permanent facility, and less soil 104 outside the perimeter of underground structure 100 needs to be excavated and subsequently back-filled.

Figure 3A:
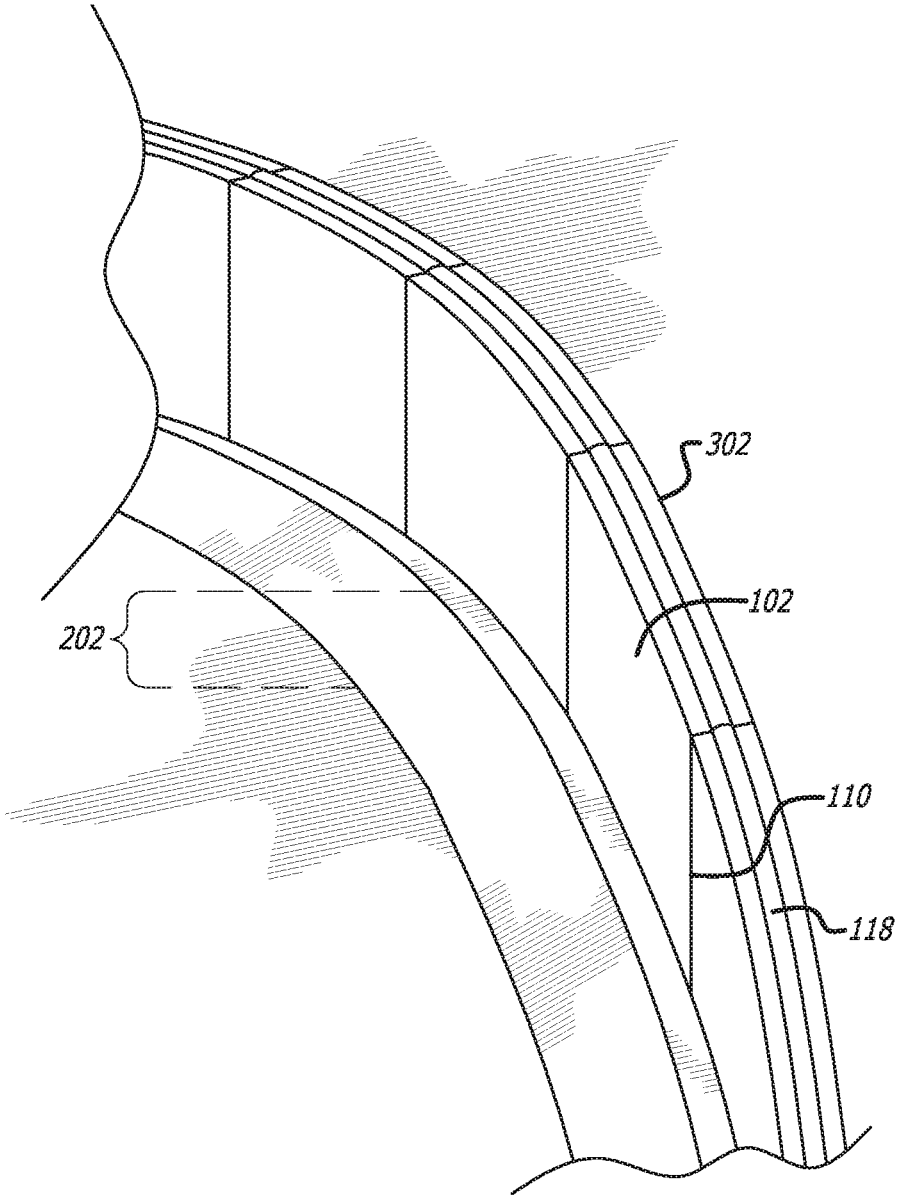
FIG. 3A illustrates an angled view of an assembled plurality of segments according to the present description where rough excavation has been performed below a completed ring.
Figure 3B:
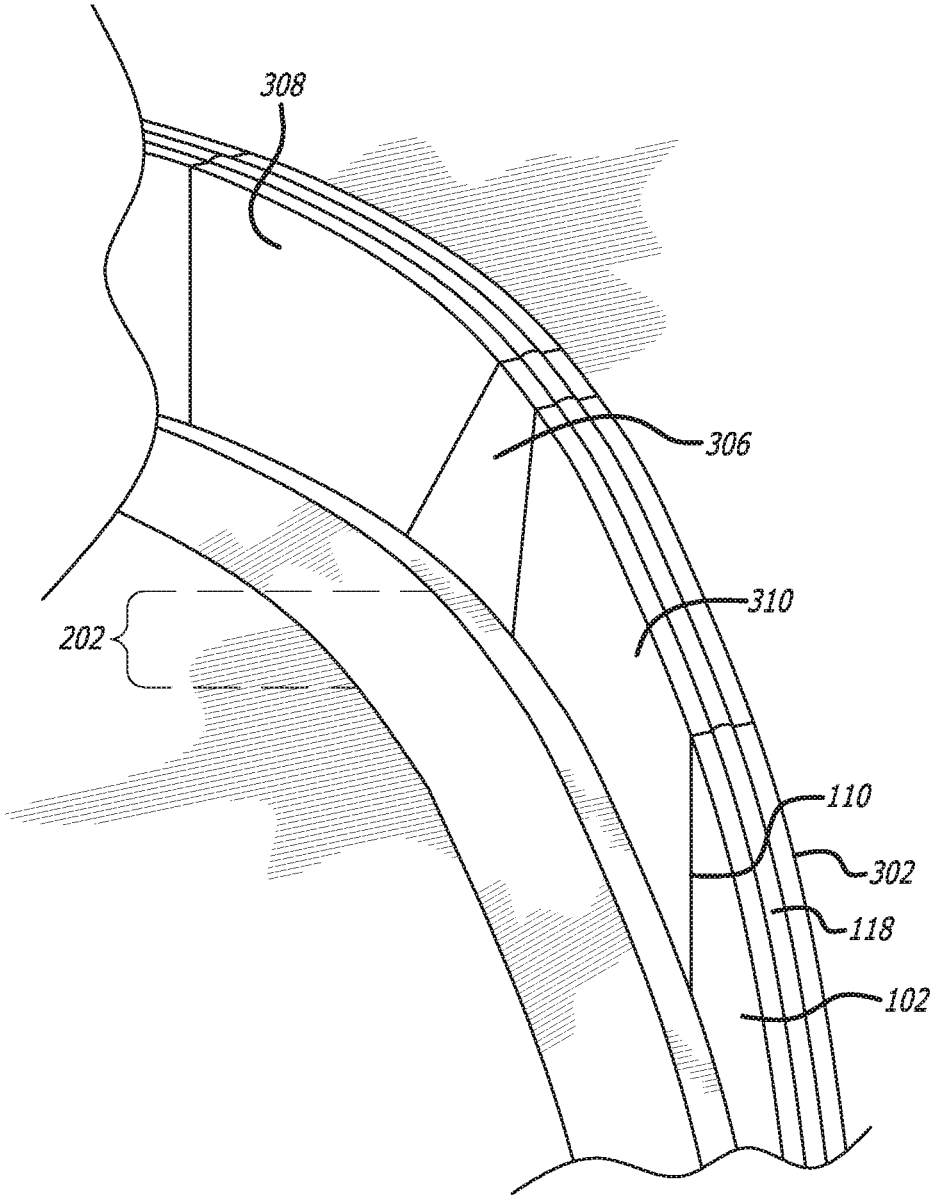
FIG. 3B illustrates an angled view of an assembled plurality of segments including an optional key segment according to the present description where rough excavation has been performed below a completed ring.

Optionally, as summarized earlier, the process of completing a ring can be facilitated by the design, fabrication and placement of a special key segment 306 as illustrated in FIG. 3B. Key segment is designed to fit between left slotted segment 308 and right slotted segment 310. Further, key segment 306 is capable of allowing closure of the ring while accommodating the necessary tolerances of measurement imperfections in the ring itself. Further, key segment 306 provides additional compression of the assembled ring (hoop stress) to ensure a more adequate seal of the assembled ring. The assembly of the segments in a given ring including a key segment provides a better seal between segments thus eliminating gaps in the joints between adjacent segments by providing additional hoop stress. Key segment 306 can assume any shape that might assist in completing a given ring while providing the characteristics described above. Additionally, left slotted segment 308 and right slotted segment 310 are designed to accommodate any design shape that key segment 306 assumes. It is within the scope of the present description that more than one key segment 306 can be used in a given ring if needed.

Once all segments 102 of a given ring are placed, optionally including the key segment, the ring is tensioned utilizing grouting 106 delivered under pressure. Such a cylinder or cylindrical structure (a plurality of segments constructed into horizontally stacked rings as described above) efficiently restrains lateral earth pressures acting against it, thus retaining soil 104, and also providing permanent foundational support to underground structure 100, while also providing for drainage of moisture using dampproofing material 108, preventing moisture from entering the interior space by diverting water to a specific, predetermined location within the structure for removal.

In order to properly seal the internal space of the structure from water and to provide proper drainage of water outside the underground vertical structure, a waterproofing system is utilized. The waterproofing system is designed to prohibit moisture intrusion into the structure's interior and comprises one or more products working together to inhibit water migration past the structural wall. The first component of the waterproofing system is dampproofing material 108 which is designed to intercept moisture in soil 104 and channel it vertically down to a collection system at the base of the underground vertical structure wherein it is disposed of by pumps. The second component of the waterproofing system is grout 106 which can either be engineered to inhibit moisture transmission (waterproofing), or permeable to allow moisture to permeate down through it's matrix to the before mentioned collection and disposal system. The third component of the waterproofing system is an elastomeric waterproofing membrane product applied to segments 102 to prohibit moisture from penetrating into, and ultimately through segments 102. The forth component of the waterproofing system are joints 110 designed with polymer gaskets, for example ethylene propylene diene M-class (EPDM) rubber, set into preformed channels that frame the entire perimeter of segments 102. When segments 102 are compressed against each other with polymer gaskets in place, a waterproof barrier is formed. The final component of the waterproofing system is contained in the concrete of segments 102. Most concretes absorb water, therefore, the present design incorporates the use of very high strength concrete (7000 to 8000 psi unconfined compressive strength) containing chemical additives engineered to inhibit moisture absorption. The present methods and systems, as described herein, can utilize one or all of the waterproofing system components if impedance of moisture will be an issue with the underground vertical structure being constructed.

In certain applications, the underground structure can be further supported by conventional continuous exterior wall footings incorporating post-tension anchors (not illustrated) with cables that are threaded vertically through first conduit 808 and second conduit 810 (see FIGS. 8-10) in segments 102. The post-tension cables are secured to the top structural deck or top ring of underground structure 100, thereby providing further security that segments 102 are properly seated and affording a level of prevention from segments 102 shifting over time.

In preferred embodiments according to the present description, a ring including one ore more segments 102 can range from a minimal radius of about 25 ft to those of a large radius of about 200 ft. However, it is preferred for certain applications that the radius be greater than about 150 ft. In certain embodiments, the radius can be about 50 ft, about 100 ft, or about 150 ft. While a variety of depths are possible ranging from about 5 ft to depths of about 40 ft up to about 70 ft, typically preferred embodiments of the present description, in the form of a parking garage, have depths up to about 40 ft. In certain embodiments, the depth can be about 20 ft, about 30 ft, about 50 ft, or about 60 ft. Practically, any underground vertical structure requiring earth retention can utilize such efficient technology. Examples of such underground structures are: temporary or permanent construction works, underground housing, storage, liquid or gas fuel storage, water reservoirs, parking lots, utility facilities, or transportation facilities. In some applications of this technology, the underground structure will serve as a foundation for an above ground structure (e.g. multi family housing, retail, or commercial office space) built on top.

The present disclosure exhibits a number of innovations over previous underground structures. Most notably, embodiments of the present disclosure utilize one or more segments 102, a plurality of segments, configured to be assembled onto vertically stacked horizontal rings. The underground structures described herein form large diameter underground cylinders. The rings are erected one at a time, downward, serving purposes of both: (i) temporary excavation shoring, and (ii) permanent perimeter structural walls in underground structures. In conjunction with its circular geometric shape and design of joints 110 between segments 102, embodiments of the present description efficiently restrain lateral earth pressures acting against the structure, thus retaining soil 104 and providing permanent foundational support for one or more above ground structures.

The circular segmented ring design utilizes the strongest geometric shape (a circle in compression) to efficiently resist the lateral earth pressures. Typical previous underground structures and construction means utilized straight walls typically following linear property lines. Consequently, conventional wall design must therefore obtain its ability to resist the earth pressures from among other things, its structural components, requiring reinforced or thick walls, also known as retaining walls. In the underground vertical structures described herein, the loading of the soil pushes against completed ring 302 (completed ring 302 being a fully assembled and grouted ring ready for further excavation below), and instead of all of the resistance coming from its flexural strength, as is the case with retaining walls, some of the loading is resisted by the hoop stress on completed ring 302.

Soil loading is resisted by the both flexural strength of segments 102 and hoop stress of completed ring 302, and distributed via axial forces throughout the entire ring. The segmented geometric form further enhances the strength of underground structure 100 by virtue of its design. As soil 104 applies pressures to one of segments 102 of a given ring, one or more other segments in the ring transfer the load throughout the ring and are then resisted by earth pressures acting elsewhere on the ring. Moreover, segments 102 manufactured using precast concrete take advantage of the intrinsic compressive strength and attributes of concrete itself.

Furthermore, the variable design qualities of underground structure 100 and its use over time are unique and advantageous. The system first acts as an unrestrained wall allowing the use of active design loads during the excavation phase, and then becomes a restrained wall (following the installation of braces or slabs) capable of resisting the higher at-rest earth pressures and other wind and seismic loads in its final form. The uniqueness of this phased design is accomplished by use of (initial phase) flexible segment-to-segment joints allowing slight deformations in ring geometry in response to possible earth pressure variations followed by a stiffening of the structure (secondary phase) after the installation of the horizontal braces or slabs and the vertical post-tensioning (if utilized) or bolted fixings (if utilized).

To comply with typical soils mechanics and construction safety regulations, an exemplary underground structure according the present description is built consecutively in 5 ft high rings from of a plurality of segments 102. Returning to FIGS. 1-7, excavation of a 5 ft deep area is followed by placement of segments 102 and optionally a key segment (not shown) to form completed ring 302 (partially shown), which serves as an exterior wall in the underground structure. As each ring is below the typical maximum threshold depth requiring temporary support, excavation and construction of underground structure 100 can continue downward without the necessity of any temporary shored walls. Where necessary, as illustrated in FIGS. 1, 2, 5, 6 and 7, a plurality of supports 112 can be used to keep segments 102 in place prior to grouting while excavation and segment placement occurs around the rest of the ring. Supports 112 can be in the form of hydraulic, electric or mechanical jacks.

(II) Pre-Manufactured Segments

Figure 8:
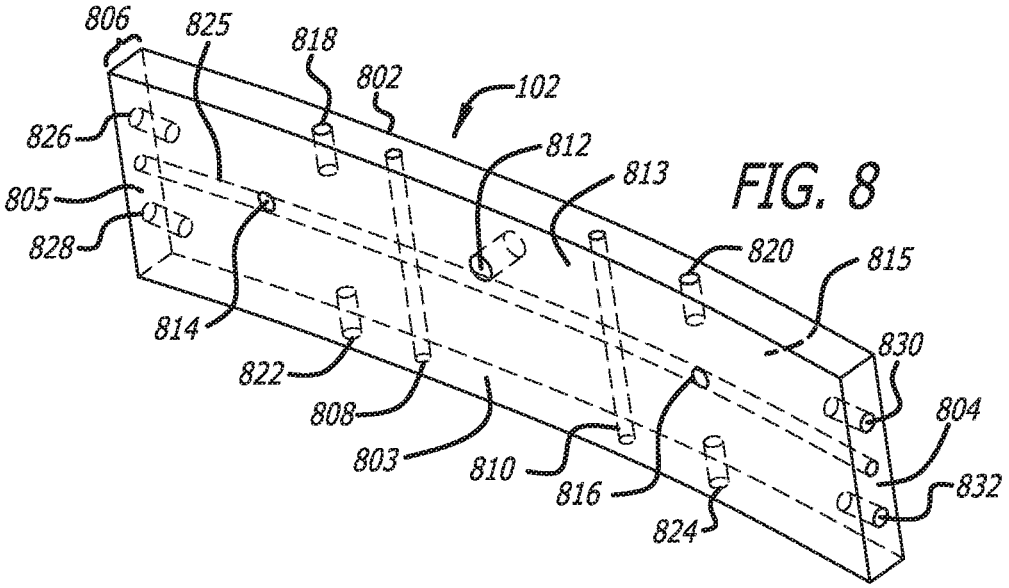
FIG. 8 illustrates an isometric view of a precast segment according to the present description.
Figure 9:
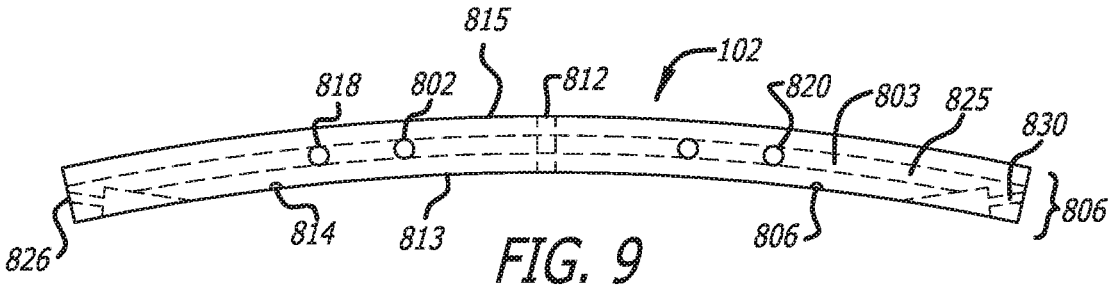
FIG. 9 illustrates a top view of a precast segment according to the present description.
Figure 10:
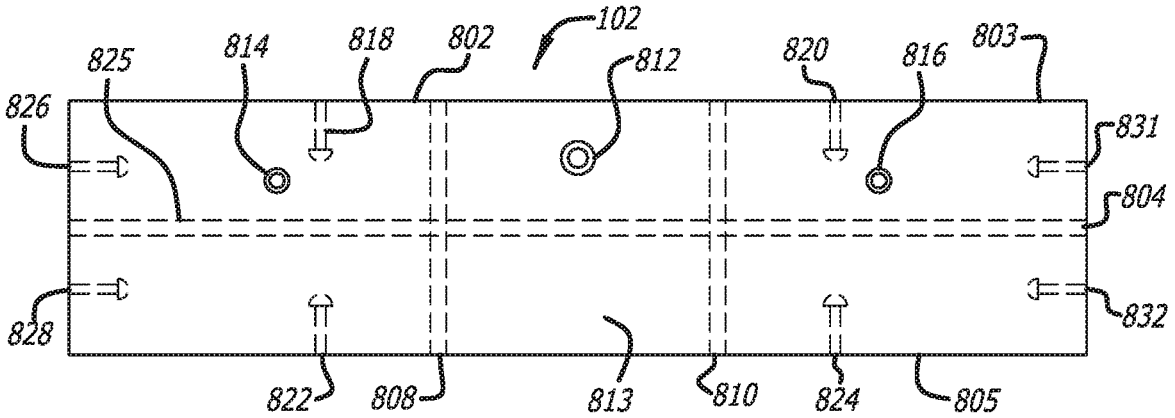
FIG. 10 illustrates an alternate view of a precast segment according to the present description.

Turning to FIGS. 8-10, the utilization of high strength pre-manufactured components as segments 102 reduces total construction time. Typically, but not essentially, segments 102 are constructed of precast concrete and can optionally contain reinforcement therein. Embedded fiber and/or steel reinforcement can be utilized in the manufacture of segments 102 to provide additional strength to segments 102 and aid in control of cracks and moisture intrusion. Concrete or other material used to manufacture segments 102 can be of natural colored gray, or incorporate color and textures to improve the esthetics and light reflectivity of the perimeter walls.

In one embodiment according to the present description, segments 102 are about 20 ft long on top horizontal face 802 by 5 ft wide on right vertical face 804, with thickness 806 of about 1 ft. The height of segments 102 is typically determined by the maximum allowable vertical unsupported temporary soil excavation, which is generally 5 ft to 6 ft, but can be larger if regulations and soil mechanics allow such an increase in height. Returning briefly to FIGS. 1, 2, 5 6 and 7, a plurality of supports 112 can be used during the placement process to ensure that each of segments 102 remains in position prior to ring completion/grouting. The length of segments 102, as illustrated by top horizontal face 802, may be varied as desired by the application. In particular, in certain embodiments, segments 102 with top horizontal face 802 of less than 20 ft are advantageous for applications requiring thicker and subsequently heavier segments.

Vertical segment-to-segment joint design provides acceptable joint 110 flexibility, while maintaining full vertical surface contact for transmission of axial forces during the temporary excavation phase allowing the use of active pressures for ring and segment structural design during this phase of construction. The horizontal segment-to-segment design can incorporate a jointed keyway allowing slight movement of segments 102 during the process of applying grout 106 with maximum movement thresholds that keep each of segments 102 in proper alignment during the backfill with grout 106. The use of optional pre-manufactured key segments used to complete a ring provide for construction tolerances joining the final segment placed to the first segment placed in each segmented ring.

Additionally, segment-to-segment joints are aligned and sealed using one or more matched protrusion and indentation on one or more adjacent segments 102. Such features are not illustrated in FIGS. 8-10, but can be seen in FIGS. 1, 3, 4, 5 and 7. For example, tongue 118 on top horizontal face 802 of segment 102 will match up with an opposite groove in an adjacent upper segment or segments 102. Additionally, groove 120 on right vertical face 804 of segment 102 will match up with an opposite tongue in an adjacent lateral segment 102. The two other non-depicted faces of segments 102 will have tongue and grove configurations as well which compliment the two described above (e.g. bottom groove and opposite side tongue).

Another type of segment-to-segment joint includes dowels that fit into channels or groves precast into each segment's radial or vertical joints. This dowel acts like a shear key on an axel; allowing rotation of the joint but no lateral (or shearing) movement of the jointed segments.

If desired, additional reinforcement of the structure can be supplied by installation of vertical post-tension strands (not illustrated) into prefabricated first conduit 808 and second conduit 810 located inside segments 102 and emerging on top horizontal face 802 and bottom horizontal face 803 to provide resistance to overturning forces due to wind and seismic actions, and to resist changes in earth pressures on the restrained wall possibly in concert with slabs that may be present and which, if present, act to brace the wall in its final configuration.

Further, if desired, additional reinforcement of the structure can be supplied by installation of horizontal post-tension strands (not illustrated) into prefabricated horizontal conduit 825 located inside segments 102 and emerging on left side vertical face 805 and right vertical face 804 to provide resistance to resist changes in earth pressures on the restrained wall possibly in concert with slabs that may be present and which, if present, act to brace the wall in its final configuration.

In another embodiment, one or more grout port 812 are configured as an imbed through segments 102. Grout port 812 emerges on front face 813 and back face 815 of segments 102. Grout port 812 provides the connection of temporary grout placement lines and can also provide a threaded receiver to plug up the hole following completion of the application of grout 106 behind a completed ring made of a plurality of segments 102.

Returning to FIG. 5, the lifting and placement, both horizontal and vertical, of segments 102 are accomplished via the use of a segment handling device 502 (attached to a conventional hydraulic arm 302) that firmly grasps segments 102 and allows manipulation of segments 102 in all three dimensions for transportation and placement. Preferably, segment handling device 502 is attached firmly to segments 102 utilizing quick connect/disconnect hardware and first complimentary hardware imbed 814 and second complimentary hardware imbed 816 formed or placed into segments 102 during manufacture. It is within the scope of the present disclosure that more than two complimentary hardware imbeds can be precast into segment 102 to allow more easy mobility of segments 102. Other methods utilized in the industry to move and manipulate segments 102 include vacuum or rubber suction implements that adhere to the smooth concrete surface of segments 102 thereby holding segments 102 affixed to the piece of equipment used to move segments 102 to the installation location.

In order to avoid tensile cracking of segments 102 during operations of manufacture, transport, and installation, reinforcement can be provided to prevent cracking at an early age when the concrete has not reached its design compressive strength. Such reinforcement designs vary depending upon the length, width and depth of segments 102. Examples of reinforcement include steel reinforcing in the form of bars with deformed knuckles or protrusions (commonly termed "rebar"), thin metal or fiber strands 2 to 2.5 inches long, hybrids like welded wire mesh that use thinner gauge wire welded in a grid pattern, and cellulose fibers.

(iii) Construction and Design Considerations and Methods of Making

Typically, construction as described herein utilizes a multi-phase process which renders a completed underground vertical structure. The first step in construction of an underground vertical structure according to the present description is excavating of earth in a desired ring shape of predetermined diameter (or radius) allowing for the assembly of a plurality of segments 102. Then, the installation of one or more components of a waterproofing system is commenced along the newly excavated wall. Perimeter structural wall waterproofing is accomplished with several measures.

One or more component of a waterproofing system can be utilized. The waterproofing system is designed to prohibit moisture intrusion into the structure's interior and comprises one or more products working together to inhibit water migration past the structural wall. The first component of the waterproofing system is dampproofing material 108 which is designed to intercept moisture in soil 104 and channel it vertically down to a collection system at the base of the underground vertical structure wherein it is disposed of by pumps. The second component of the waterproofing system is grout 106 which can either be engineered to inhibit moisture transmission (waterproofing), or permeable to allow moisture to permeate down through it's matrix to the before mentioned collection and disposal system. The third component of the waterproofing system is an elastomeric waterproofing membrane product applied to segments 102 to prohibit moisture from penetrating into, and ultimately through segments 102. The forth component of the waterproofing system are joints 110 designed with polymer gaskets, for example ethylene propylene diene M-class (EPDM) rubber, set into preformed channels that frame the entire perimeter of segments 102. When segments 102 are compressed against each other with polymer gaskets in place, a waterproof barrier is formed. The final component of the waterproofing system is contained in the concrete of segments 102. Most concretes absorb water, therefore, the present design incorporates the use of very high strength concrete (7000 to 8000 psi unconfined compressive strength) containing chemical additives engineered to inhibit moisture absorption. The present methods and systems, as described herein, can utilize one or all of the waterproofing system components if impedance of moisture will be an issue with the underground vertical structure being constructed.

In certain embodiments of the present description, dampproofing material 108 is a drainage composite (e.g. damp proofing) and should be installed proximate to the soil face, providing a path for moisture to move to a collection system at the bottom of the wall or at the foundation of the structure. Dampproofing material 108 can most easily be installed onto the soil face using nails large enough to hold up waterproofing material during construction.

Once the space for the new construction (ring) has been excavated and the waterproofing system installed, segments 102 can then be placed end to end forming a ring, which is ultimately incorporated into underground structure 100. Upon placement of segments 102, grout sealing shelf 114 is installed under segments 102. Grout sealing shelf 114 prevents grout 106 from seeping out the bottom of the assembled ring of segments 102. The top of a newly assembled ring of segments 102 is sealed using a top grouting shelf if the ring is the first in the structure. If the newly assembled ring is a second or subsequent ring, completed ring 302 directly on top of the newly assembled ring acts as the seal on the top.

The entire assemblage of segments 102, grout sealing shelf 114 and any other installation material can be held in place by plurality of supports 112 to maintain the placement and orientation of the newly placed segments until all required segments are installed and the ring is finished and grouting can be commenced, thus engaging a newly completed ring 302 with the soil and supporting further excavation. Plate 116, made of any material that can support the weight of segments 102, for example, wood, timber or steel, can also be placed under plurality of supports 112 to aid in stability. Plate 116 is commonly referred to as dunnage.

One or more horizontal and/or vertical support members in the form of bolts can optionally be installed to aid in integrity of the underground structure. As depicted in FIG. 10, bolted connections to assist in alignment and attachment during erection and application of grout 106 can be incorporated into the design. For example, vertical bolt connections 818, 820, 822, 824 and horizontal bolt connections 826, 828, 830, 832 are useful for this implementation. Connectors within or on segments 102 will also aid in allowing joint flexibility while maintaining physical constraints to joint deformations in excess of design limits.

Figure 11:
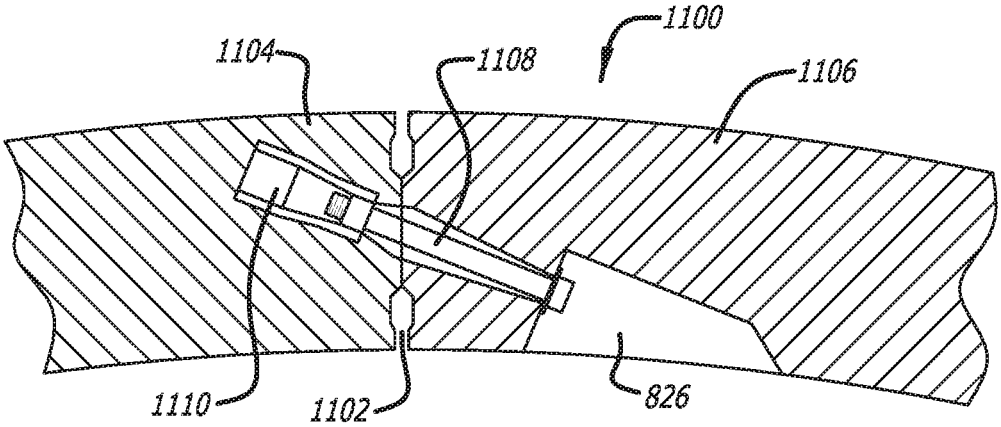
FIG. 11 illustrates a bolted segment-to-segment joint according to the present description.

FIG. 11 illustrates an exemplary embodiment of bolted joint 1100. Therein, joint 1102 between first bolted segment 1104 and second bolted segment 1106 is connected using first bolt 1108. First bolt 1108 can be threaded though horizontal bolt connector pocket 826 and a second vertical bolt connector (not shown) or threaded through horizontal bolt connector pocket 826 and bored directly into first segment 1104 through threaded concrete imbed 1110.

Figure 12:
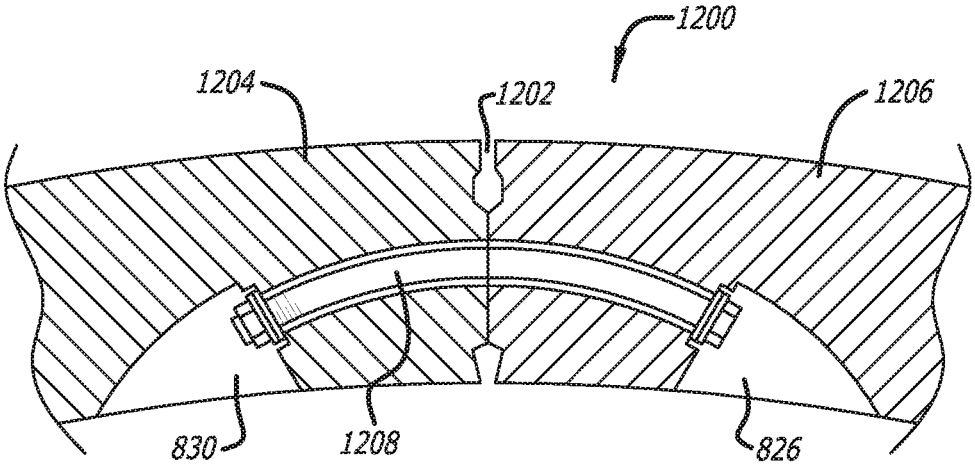
FIG. 12 illustrates an alternative bolted segment-to-segment joint according to the present description.

FIG. 12 illustrates a second exemplary embodiment of bolted joint 1200. Therein, second joint 1202 between alternate first bolted segment 1204 and alternate second bolted segment 1206 is connected using second bolt 1208. Curved bolt 1208 can be threaded though horizontal bolt connector pocket 826 and a second vertical bolt connector pocket 830.

Once plurality of segments 102 is assembled, supported and sealed as described above, grout 106 can be delivered under pressure to the void behind the newly assembled ring and soil 104, optionally covered with dampproofing material 108. The use of a high strength cement (e.g. bentonite) as grout 106 for backfill grouting places the newly assembled ring comprising plurality of segments 102 in full contact with soil 104 allowing complete load transfer of soil pressures onto the completed ring 302. Additionally, grout 106 renders several benefits, namely it restores the in situ pressures of soil 104 to minimize the potential for adjacent surface settlement, it aids in distributing the hoop stress to the ring structure and aids in waterproofing the structure from ground water.

Several alternatives to high strength cement for use as grout 106 can be used according to the present description. On type of exemplary grout 106 uses cement as a binder and is low in strength 50 to 250 psi when compared to high strength conventional neat cement grout (2500 to 5000 psi) typically used in underground permeation or rock bolt grouting. This low strength cement based grout is referred to as controlled low strength material (CLSM). Another exemplary grout 106 uses unconventional binders such as polymers and/or asphalt emulsions mixed with various unconventional aggregates like styrofoam beads, recycled tire rubber, volcanic ash (pumice) or fly ash derived from coal burning electrical generating plants.

In cases where the potential for significant variations in soil 104 pressure are considered a possibility, specialized compressible grouts (cellular grout) can by utilized in place of or in conjunction with grout 106 used for backfill. Use of such compressible grouts allows for more efficient designs of segment 102, because the variable soil pressures and pressure increases from active to at-rest are mostly absorbed by deformation or compression of grout 106, and thereby do not cause large distortions of the ring geometry or require substantially higher flexural strengths in segments 102.

In instances where deformation or compression of grout 106 exist or might exist, the use of polyethylene discs in portions of the annulus, between a newly assembled ring and soil 104, that will perform as soil pressure shock absorbers can be utilized. Other polymeric disks that provide shock absorbing characteristics are understood to be within the scope of the present disclosure. The shock absorbing devices may be used in conjunction with grout 106 or without grout 106.

Once the annulus between an assembled ring and soil 104 has been backfilled with grout 106 and grout 106 has cured, a ring is considered complete. Once a ring at one level has been completed, thereby providing completed ring 302, excavation below can result in lateral pressures applied to the ring to increase. Further, it has been calculated that pressures nominally increase the deeper the rings are excavated and placed. Both of the above factors should be considered in segment 102 design.

Figure 1:
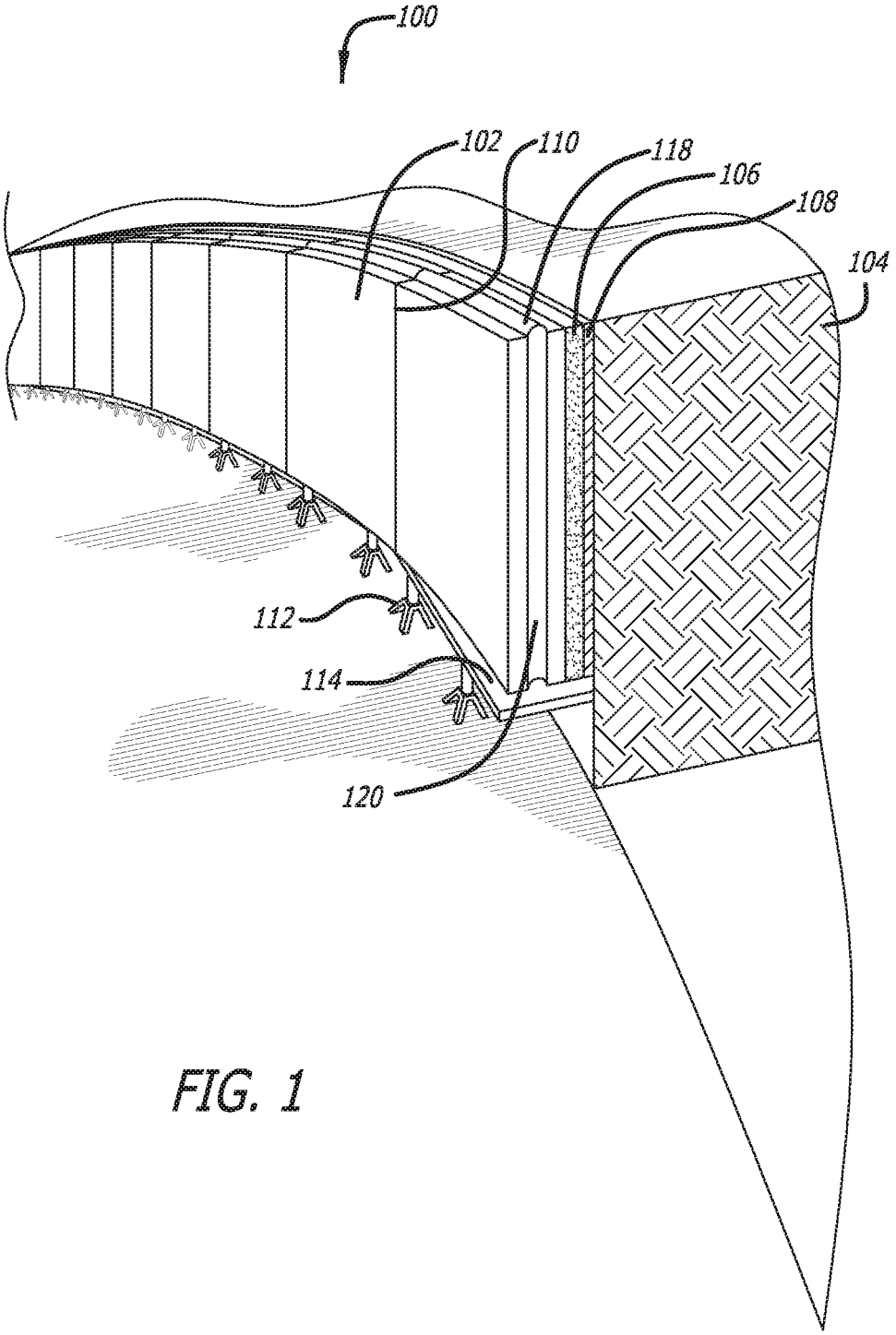
FIG. 1 illustrates an angled view of a plurality of segments according to the present description.
Figure 2:
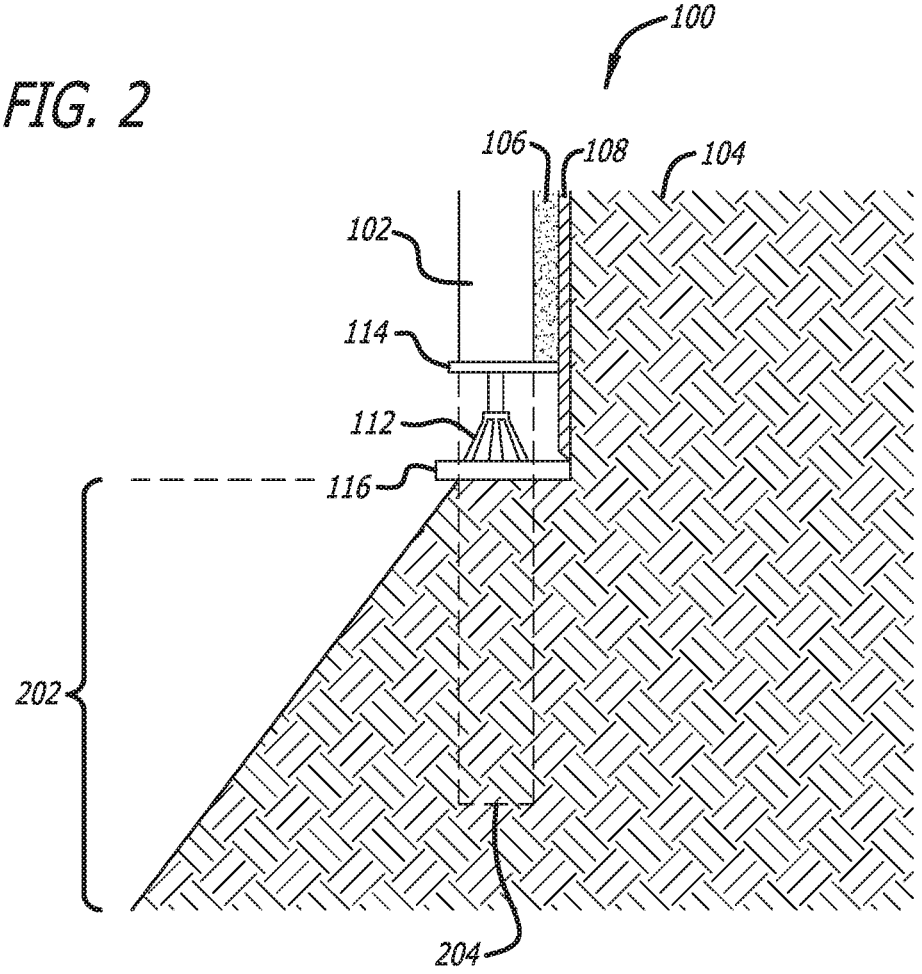
FIG. 2 illustrates a cross-sectional view of a ring comprising a plurality of segments according to the present description.

Turning to FIGS. 2 and 3, first, once a ring has been completed, rough excavation 202 assures both slope stability and construction personnel safety, wherein rough excavation 202 is generally about 5 ft or 6 ft tall to allow for eventual assembly of another plurality of segments 102, but the height of rough excavation 202 depending on local safety regulations, but can be as tall as safety regulations allow.

Figure 4:
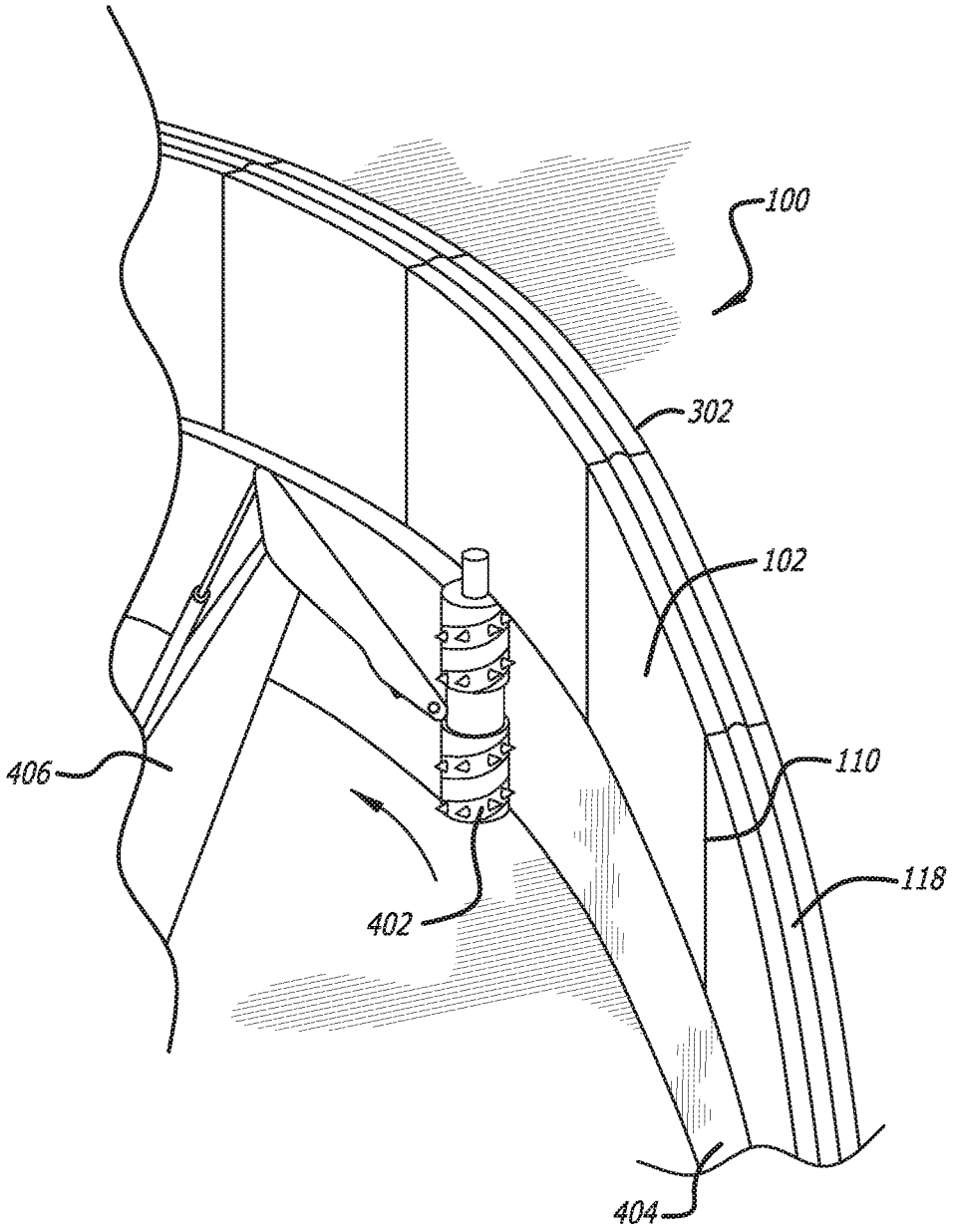
FIG. 4 illustrates an angled view of a plurality of segments according to the present description depicting fine grade excavation being performed on the rough excavation under the assembled plurality of segments.
Figure 5:
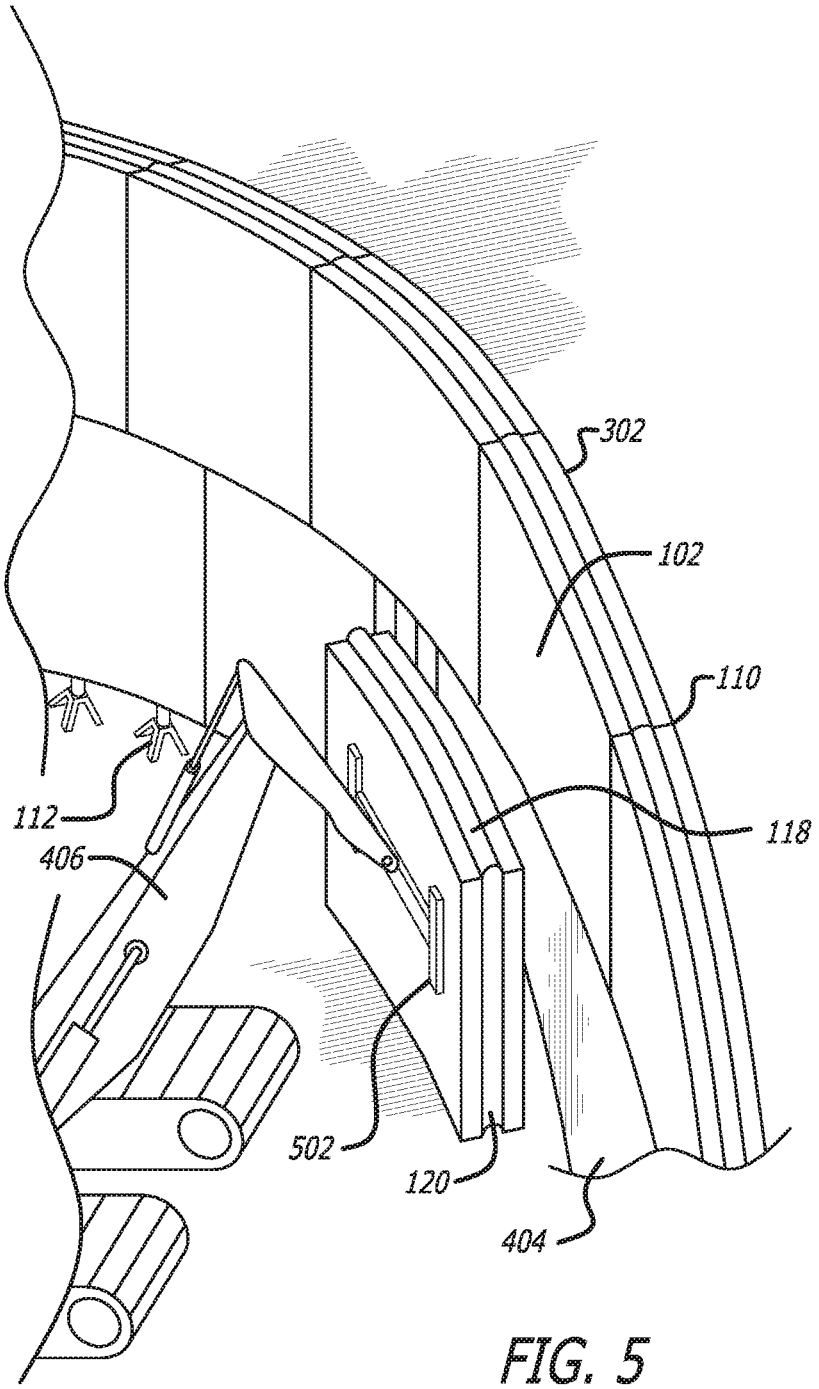
FIG. 5 illustrates an angled view of a plurality of segments according to the present description depicting the placement of a segment with a segment handling device attached to a hydraulic arm.
Figure 6:
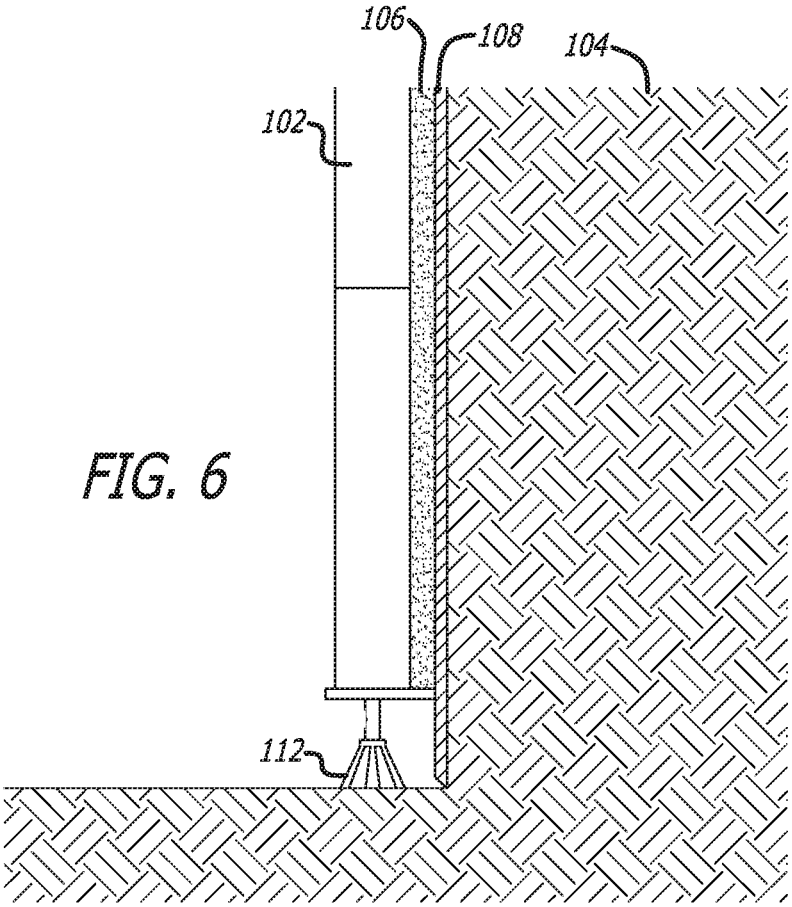
FIG. 6 illustrates a cross-sectional view of a second ring completed under a first completed ring according to the present description.
Figure 7:
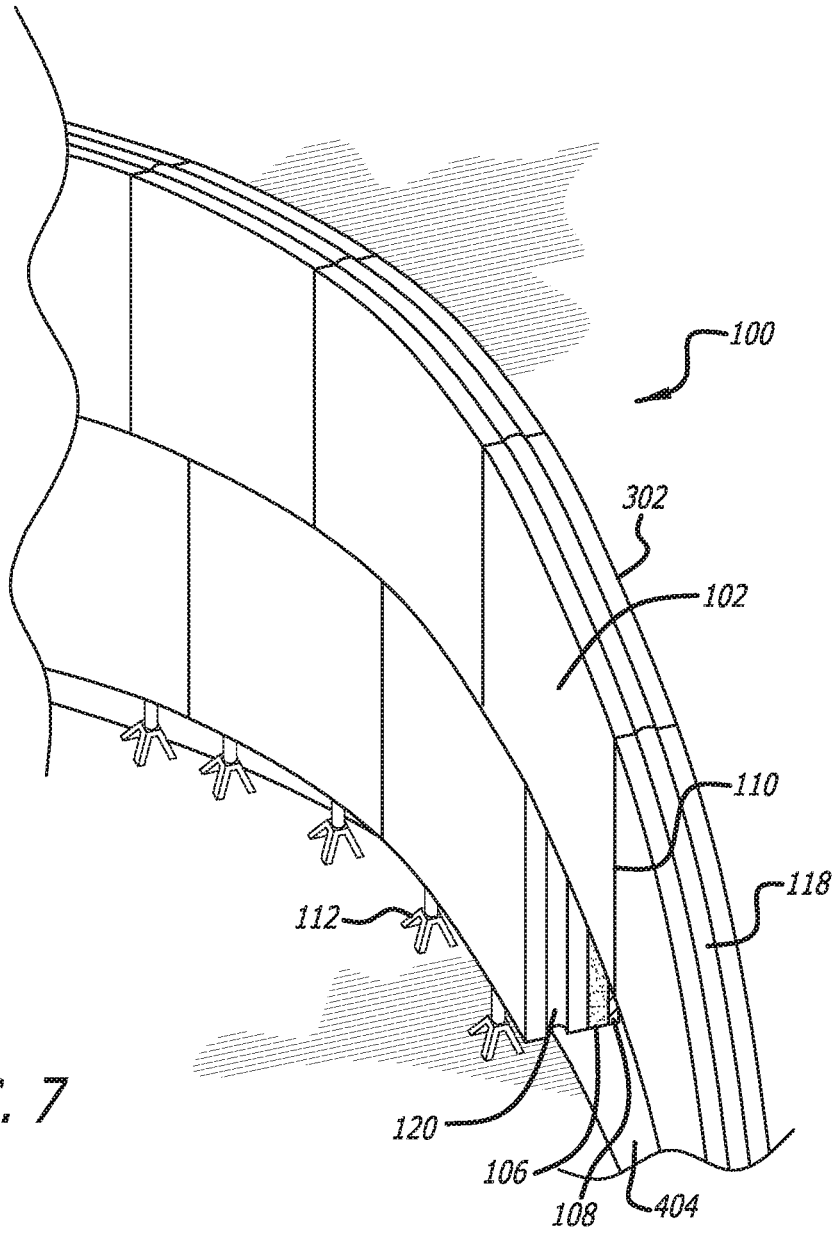
FIG. 7 illustrates an angled view of an assembled plurality of segments with a second ring of segments assembled thereunder according to the present description.

Turning to FIG. 4, vertical fine grade of rough excavation 202 is accomplished utilizing powered cutter drum implement 402 mounted upon hydraulic arm 406. Powered cutter drum implement 402 facilitates accurate annulus width between the back of the concrete segments 102 and soil 104, which is now freshly excavated, utilizing completed ring 302 as a precise guide for the tool. This trimming produces a vertical soil face 404.

Once soil 104 below completed ring 302 has been excavated for an additional plurality of segments 102 producing vertical soil face 404, the assemblage of an additional plurality of segments 102 of a new ring can begin and proceeds as described above. As work proceeds, soil 104 is exported from the inner perimeter of the structure to machinery waiting to export it to another location. In most applications where water drainage is desired dampproofing material 108 and/or drainage composite is installed on newly excavated vertical soil face 404.

Segments 102 are transported to the perimeter of the structure and installed adjacent to newly excavated vertical soil face 404 under completed ring 302 in a circular fashion. Typically, segments 102 are handled and placed using a special attachment, segment handling device 502, connected to hydraulic equipment, hydraulic arm 406, allowing a three dimensional manipulation of segments 102 into the structure and into future segment position 204, illustrated in FIG. 2 and assembled in FIG. 6. In certain applications, segments 102 with rotationally-flexible joints (rather than rigid jointed segments) can be utilized, provided that the larger displacements under point load conditions can be tolerated and the method of construction can locate segments 102 forming a ring with a sufficiently small departure from the ideal geometry.

Each subsequent ring can be completed by placement of a final optional key segment ensuring joint and tension tolerances consistent with structural design requirements. Alternatively, segments 102 can be joined to complete a ring without the use of an optional key segment. Once each additional completed ring 302 is constructed, the annulus or void is backfilled with grout 106 engaging the newly completed ring with soil 104 which now acts as earth shoring allowing this sequence to be repeated for multiple rings until a desired depth is achieved.

Preferably, once the desired depth is achieved and all segments 102 have been installed, it is preferable to install one ore more vertical support members, namely vertical post tension cables (tendons) that run through precast conduits, first conduit 808 and second conduit 810, in segments 102 connecting the foundation support of the disclosed structure with any other at-grade or above-grade structural components that will be constructed in conjunction with the disclosed structure. Additionally, horizontal post tension cables can also be installed through horizontal conduit 825 located inside segments 102. Such optional post tension cables not only enhance the structural performance of each rings integration into the foundation system, but in combination with other structural components utilized in conjunction with the innovation such as horizontal diaphragm decks or stiffener rings, assist in strengthening each segments 102 capacity to resist bending moments exerted by soil 104 or other lateral or vertical stresses imposed on the design.

Optional vertical post-tensioning cables and ducts within the present systems are useful for anchoring any above grade structures to the below-grade portion of underground structure 100, for providing resistance to overturning forces resulting from wind or seismic actions on the above grade structure, and for ensuring the rings resist pressures together as a single structure rather than as individual rings.

After the underground perimeter wall structure is complete, construction of wall foundations (footings) and any required internal supports and walls is preferably commenced. Typically, column pad footings and perimeter footings are excavated, formed and poured. Where applicable, columns and interior structural walls are constructed. If an elevator is desired, the elevator shaft and elevator mechanisms can be initially completed.

In certain applications, soil 104 grouted to its active pressure may subsequently creep thereby increasing lateral pressures toward the at-rest pressure. However, there is little economy gained by relying on a single layer of post-tensioning reinforcement to carry the increment in pressure (from grouting to at-rest pressures) by segments 102 spanning vertically between decks 1304, 1606, 1702. Other layout designs, possibly in combination with the use of decks 1304, 1606, 1702, embodied as horizontal slabs, which may be offset from the horizontal ring joints, may be considered to increase the efficiency/ability of the post tension cables to carry increment in pressures vertically.

For applications that require underground structure 100 to remain clear of one or more horizontal support members in the form of bracing, spanning the diameter and site/soil conditions that create additional loading over time, embodiments of the present description can further utilize cast in place concrete internal stiffener rings as bracing. Approximately 5 ft wide by 1 ft thick internal stiffener rings spaced vertically down underground structure 100, provide additional resistance to stresses placed on underground structure 100's perimeter and stiffen the wall providing restraint bracing at intervals ascending the walls height.

Where embodiments of the present description retain fluids or gases under pressure and develop interior loading that necessitates tensile strength of completed ring 302, additional reinforcement of underground structure 100 can be achieved by the optional installation one or more additional horizontal support members, namely horizontal post-tension strands installed into prefabricated conduits (not illustrated) located inside segments 102 to provide resistance to the internally applied loads created by the storage of these materials.

Additional examples of vertical and horizontal support members include construction of floors or decks 1304, 1606, 1702 within underground structure 100 utilizing horizontal structural decks varying based on structural requirements and use demands, but can be either horizontal (flat) or sloping (helical), or a combination of both. Further, vertical support members in the form of pillars or vertical joints between adjacent decks or floors can be useful. In embodiments where these structural slabs will be constructed subsequently, segments 102 can be designed to resist (during the temporary excavation phase) pressures approaching or equal to the active earth pressure, with the ring-slab system (in its final configuration) being used in combination to resist increases in lateral pressures that may develop over time.

Underground structure 100, subsequently referred to as underground structures, can be used for a wide variety of applications, including, but not limited to, housing, parking structures, large item storage, bulk liquid or gas storage, and waste and/or contaminant storage. In certain housing embodiments, it can be preferable to treat segments 102 and finished structural walls with audio and/or thermal insulation. With respect to audio insulation, this can be accommodated through various means, such as surface textures, insulation, voided segments or other conventional means. Likewise, as desired in some environments or as necessary depending upon the contents of the underground structure, additional insulation can be fitted externally, internally or in conjunction with segments 102.

In situations where soil 104 will not remain vertical during excavation, the use of geotechnical grouting (prior to excavation) in the area directly behind the perimeter wall (outside the circumference of the structure) with soil 104 stabilizing grout effectively cements the in situ soil materials, permitting safe excavation and placement of segments 102.

Depending upon the type of soil 104 located at a construction site, the amount of allowable wall deflection, depth of the underground structures, number of rings, and surcharges on the surface of soil 104 behind the wall, different tolerances and designs of segments 102 necessarily apply. Limiting states of soil pressure are active, in which soil 104 fails as the wall moves away from the supported soil, and passive, in which the wall is pushed into soil 104 thereby forming a failure wedge. The in situ horizontal soil stress condition is the "at rest" condition.

Soil and design pressures are generally assumed to increase linearly with depth and are often represented as equivalent fluid unit weights and depend on soil type. The equivalent fluid pressure approach is a reliable design tool for estimating global wall stability, and for estimating stress distributions for sizing the structural members of the wall. However, the actual lateral soil pressures exerted against a wall may differ from presumed design pressures. They may be variable along the length and depth of a wall, and they may change with time due to consolidation or wetting of soil backfill.

The initial pressure imposed against one of completed rings 302 can be carefully controlled by simultaneously pressure-grouting to a uniform design pressure. Over time, lateral pressures imposed on completed rings 302 may change as excavation progresses, as soil properties change, or as surcharge loads are imposed on soil 104 behind completed ring 302. Hence, embodiments of the present description must be designed to accommodate the initial lateral soil pressures, subsequent grout pressures and any changes in pressure that occurs subsequent to grouting. Depending upon the location, structure and application of the underground structures described herein, there are many reasons for changes (post grouting) in pressures exerted against such underground structures, which necessarily affect grout pressure design.

For example, overconsolidation of soil deposits can cause larger-than-anticipated at-rest pressures, which could result in unforeseen deformations of segments 102 and potentially damage to adjacent structures as the larger-than-anticipated lateral pressures are manifested as inward deformations of the rings. The estimate of at-rest pressures developed by the geotechnical engineer for a given site should consider the potential influence of overconsolidation.

Considering the foregoing, for soil 104 with cohesive characteristics, grouting at close to the estimated at-rest pressure would provide an economical system that should not be vulnerable to the deformation that otherwise might occur if actual soil pressures increase over time and exceed design capabilities. For soil 104 free of cohesive characteristics, or noncohesive, grouting to the estimated at-rest pressures overcomes, to a large extent, the anticipated variability in in-situ pressures.

Given the above considerations regarding the underground structure and the differing characteristics of soil 104, it is important that the structural design of the underground structures described herein accommodate some variation in lateral soil pressure demands.

As exhibited in embodiments of the present description, soil 104 and one or more completed ring 302 forms an interacting system, whereby a demand for soil pressure increase imposed on completed ring 302 would cause deflection inward toward the excavation, and the inward movement of soil 104 would thereby reduce soil pressure demand. The interaction between soil 104 and completed ring 302 can cause a beneficial evening out of soil pressures for flexible rings that can deflect in response to demands in soil 104. In that regard, when designing embodiments of the present description, one must be careful to incorporate soil 104-wall interaction when imposing non-uniform limit pressures against one or more completed ring 302, because such analysis includes the beneficial reduction in soil pressure associated with inward deformation of completed ring 302.

During interior construction, preferably the under structure drainage and utility system should be completed first. The bottom slab floor can be formed, but preferably it should not be poured until tensioning of any post-tension cables (if utilized) has been completed. Once the bottom slab floor is poured, internal construction preferably can be completed, including one or more below grade structural decks.

Internal structures as described herein are considered to be vertical and/or horizontal support members. For example, one or more floors or decks in an underground parking garage are considered to be horizontal support members. If floors or decks are slopped, the floors or decks are considered both vertical and horizontal support members.

CONCLUSION

The approaches described herein for constructing underground structures evidence a variety of benefits over previous approaches. In that regard, embodiments of the present description evidence various benefits over previous structures and previous methods of underground construction.

First, segments 102 are manufactured ahead of time permitting excavation, building construction, and earth shoring installation to occur at the same time. There is no need for drilling, setting, and curing of beams or cast-in-place concrete caissons for the purpose of temporary earth support. Secondly, the construction of the permanent exterior structure progresses at the same time as the excavation, resulting in two aspects of critical path work being accomplished simultaneously contrasted with conventionally constructed structures that progress linearly or sequentially. Thus, construction of such underground structures is typically faster than that exhibited by the previous methods.

Second, urban conventional underground facility design and construction technologies require two phases to complete a structure: construction of an earth shoring system to retain soil 104 during excavation, followed by construction of perimeter walls to permanently support the structure and excavation. The present description incorporates the temporary shoring and permanent perimeter wall systems into one. The present description eliminates the design costs, time required for construction, and construction costs required for temporary shoring construction, because segments 102 used during excavation support become a part of the permanent building system as opposed to being needlessly designed, assembled, disassembled and removed.

After the one-step cylindrical exterior structure is complete, structural deck construction can immediately commence, contrary to most underground construction projects where a delay is encountered following the erection of temporary shoring walls. In this regard, construction can proceed forward immediately from level to level without waiting for conventional perimeter walls to be constructed after the temporary shoring has been built, since the permanent perimeter walls are built during the excavation process according to embodiments of the present description.

Third, subterranean structures and installations deeper than 17 ft to 20 ft (where tie backs are not available) can be achieved without the hindrance and cost of raker beams and their required kickers due to the inherent strength of the geometric shape of the structure. The lateral earth forces (at depth) are resisted via circumferential axial force within one or more completed rings 302 and resisted by the soil pressures acting elsewhere on one or more completed rings 302. In cases where temporary shoring design require the use of tie backs, the present description saves the cost of negotiating, compensating, bonding, and documenting tie back agreements and the liability associated with use of public and others' private property.

Fourth, most building code requirements for removal of beam tops, lagging, and tieback cables/strands following the completion of the structure do not apply to the methods of the present description. The cost and schedule impacts are no longer applicable to embodiments described herein.

Fifth, some embodiments are able to maximize usable space by utilizing available site land that would have been forfeited do to current construction/shoring techniques that limit underground structure depths and construction adjacent to the project property lines.

Sixth, in certain embodiments such as a parking garage, a comparison of existing below ground structures to the present disclosure proves that most previous designs are roughly 15% less efficient in terms of space utilization than that of embodiments described herein (see Example 3). The required underground structure area and resulting costs incurred to achieve project-parking requirements is lower per stall due to the inherent efficiency of the circular drive isle and radial parking design which eliminates wasted corners from the parking layout and provides a central core for services (elevators, stairs, restrooms, equipment rooms, etc.).

Seventh, due in large part to the more efficient circular underground parking design, requiring less space per stall, this increase in efficiency not only translates to savings in structural materials, but also reduces truck traffic required for transport of soil 104 to offsite facilities and improves the air quality, noise, and traffic impacts to the community during construction.

Lastly, some embodiments described herein can effectively mitigate a common constraint on conventional construction projects, the number of parking spaces. The ability to increase parking spaces with embodiments of the present description, by utilizing: (i) available site land and depths that would otherwise have been forfeited (do to existing temporary shoring construction costs and design requirements), and (ii) by using the more efficient parking geometry, thus permits a larger project to be designed and implemented. This results in maximization of land and development values.

EXAMPLES

There are numerous and diverse additional embodiments anticipated by the present disclosure, as further summarized below. It is understood that the apparatus and methods discussed herein provide a means for creating an underground vertical structure. Therefore, it is further understood that the following examples are not limiting by nature, but rather specific examples where the disclosed apparatus, systems and methods can be utilized.

Example 1

Underground Housing

Figure 13:
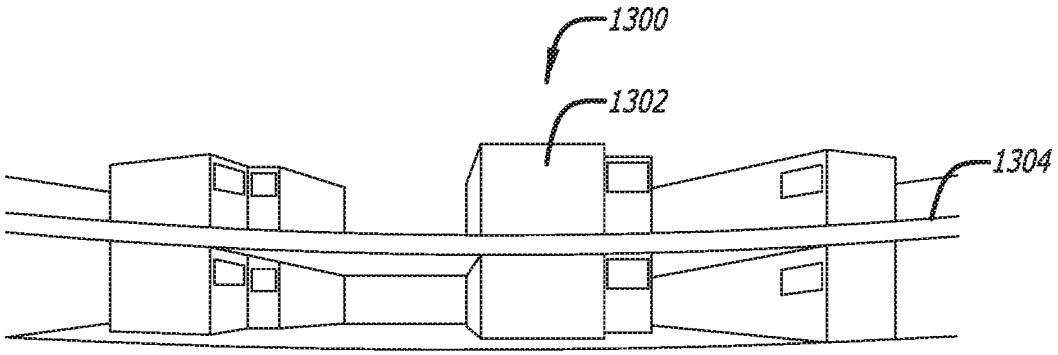
FIG. 13 illustrates an underground housing development according to the present description.
Figure 14:
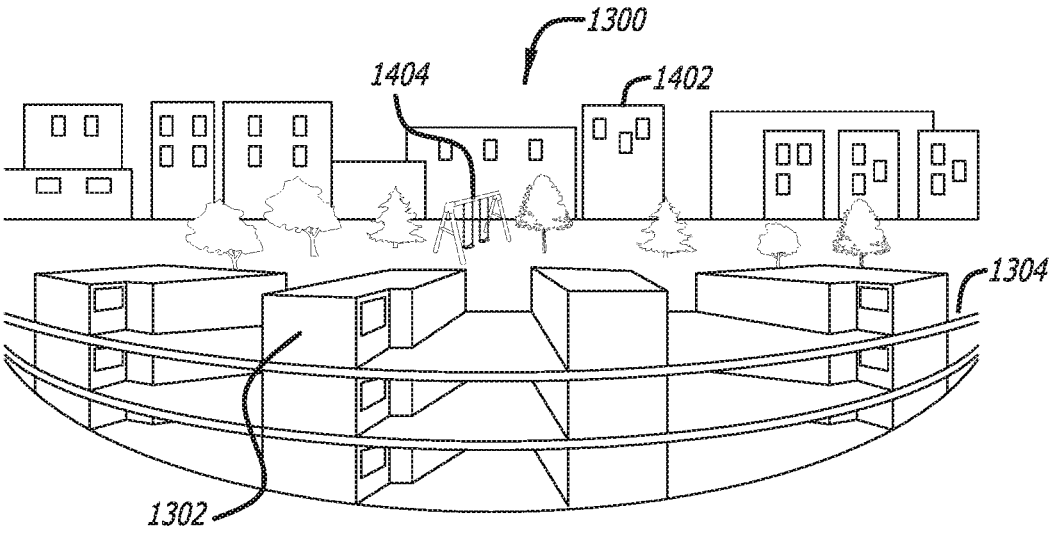
FIG. 14 illustrates an alternate view of an underground housing development according to the present description.
Figure 15:
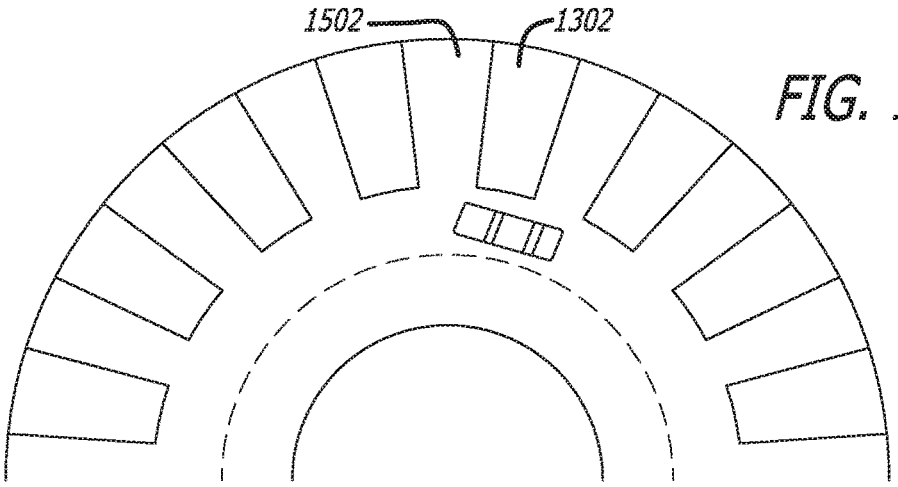
FIG. 15 illustrates a top view of a single deck of an underground housing development according to the present description including drive aisles.

Utilizing the methods, apparatus and systems as described herein, underground housing development 1300 can be constructed. Referencing FIGS. 13-15, one or more permanent residences 1302 can be constructed on one or more decks 1304. Such an underground housing development is more space efficient than above ground residences alone. Underground housing development 1300 can be constructed underneath one or more above ground housing development 1402, above ground park 1404 or any other structure within the purview of one skilled in the art of construction and architectural design. Such a design thereby increases the potential residence per acre efficiency.

A further aspect of underground housing development 1300 is the ability to incorporate resident parking. One or more parking spaces 1502 or garages (not shown) can be constructed adjacent to permanent residences 1302. Therefore, wherein most above ground, high capacity residential buildings do not have adjacent access to parking, such an embodiment is achievable using the methods, apparatus and systems as described herein.

Example 2

Mass Transit Underground Station

Figure 16:
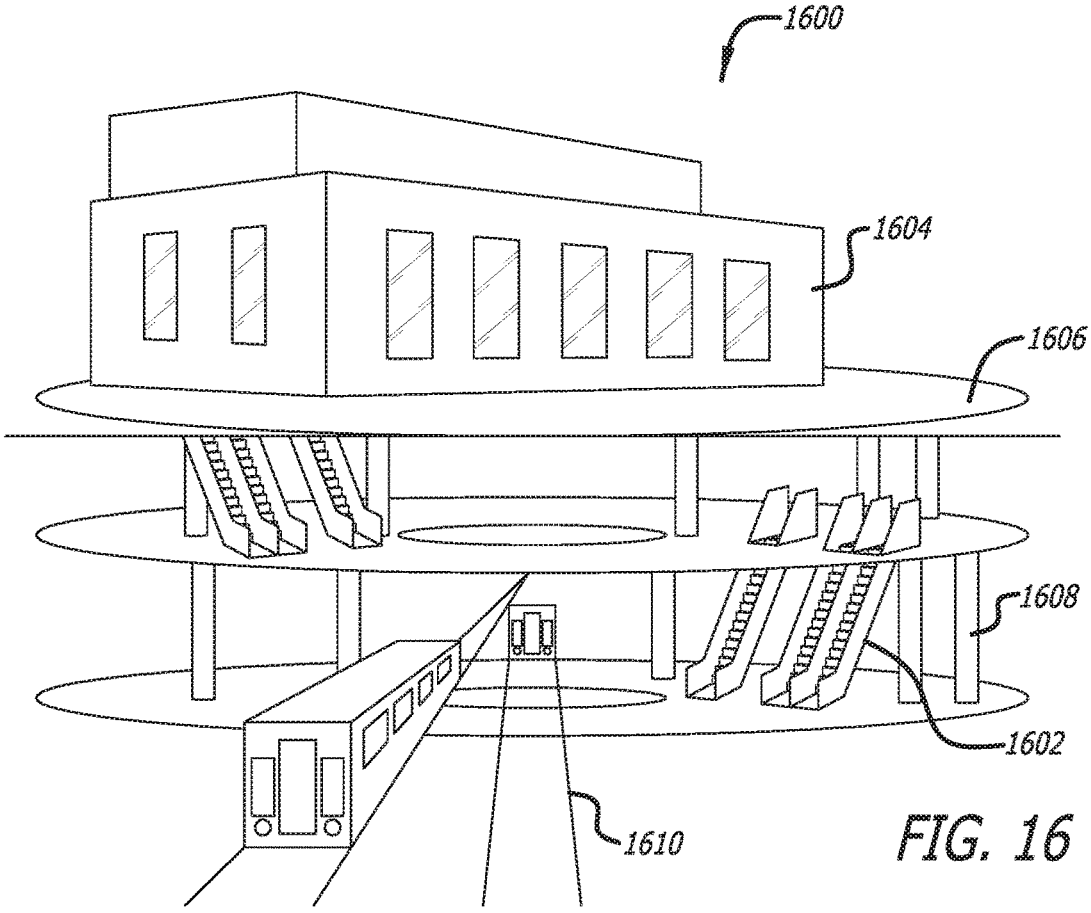
FIG. 16 illustrates a mass transit underground station according to the present description.
Figure 17:
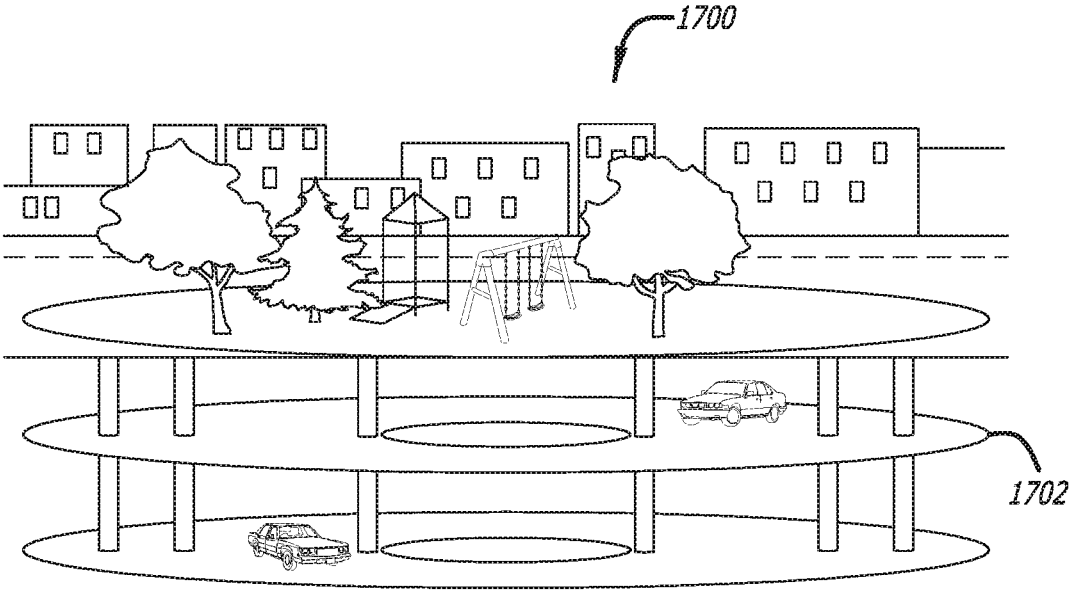
FIG. 17 illustrates an underground parking structure according to the present description.

One or more mass transit underground stations are constructed utilizing the methods, apparatus and systems as described herein. Mass transit includes subway lines, above ground commuter trains, busses, taxi cabs, trolleys, monorails and the like. Station 1600, as illustrated in FIG. 16, includes all amenities of previous stations including one or more escalators 1602, ticketing building 1604, one or more decks 1606 (horizontal support members), one or more vertical columns 1608 (vertical support members) used to support the vertical components of the structure, one or more rail lines 1610, one or more elevators (not shown), one or more ramps allowing access between the one or more decks (not shown, vertical and horizontal support members).

Example 3

Underground Parking Structure

The underground vertical structures described herein can be utilized as underground parking structures. A radius of 149 ft (one-hundred forty-nine feet) or less and about 40 ft deep has been shown to be a preferable and efficient size for an underground parking structure. Notwithstanding, underground structures in excess of 149 ft in radius and 40 ft deep can be successfully erected, namely by utilization of thicker segments 102, providing larger diameter structures.

In cases where embodiments of the present description are used for underground parking structures, the physical circular shape in conjunction with either helical or flat slabs, yield efficiencies in site planning for parking spaces in comparison to conventional rectilinear parking structure site design. These efficiencies are captured in less total gross structure square footage required per parking space.

In other embodiments, a system of reinforced concrete columns supported on conventional pad footings supports a mild steel helical or horizontally designed structural parking deck. The parking deck begins from the bottom of the excavation and terminates at grade (ground level). It is further advantageous to then construct a flat podium deck approximately 12 ft above grade suitable for supporting multiple stories of wood framed apartment units or commercial office or retail space.

Parking structures are built in conjunction with the methods, apparatus and systems as described herein. Underground parking structure 1700, illustrated in FIGS. 17-20, can be constructed as a standalone parking facility or can be constructed in conjunction with an underground housing facility, mass transit underground station, constructed in conjunction with above ground office buildings, retail centers, housing or the like. Depending on the diameter of the underground structure, the configuration of the underground parking structure 1700 takes many different configurations to achieve the highest parking efficiency.

Figure 18:
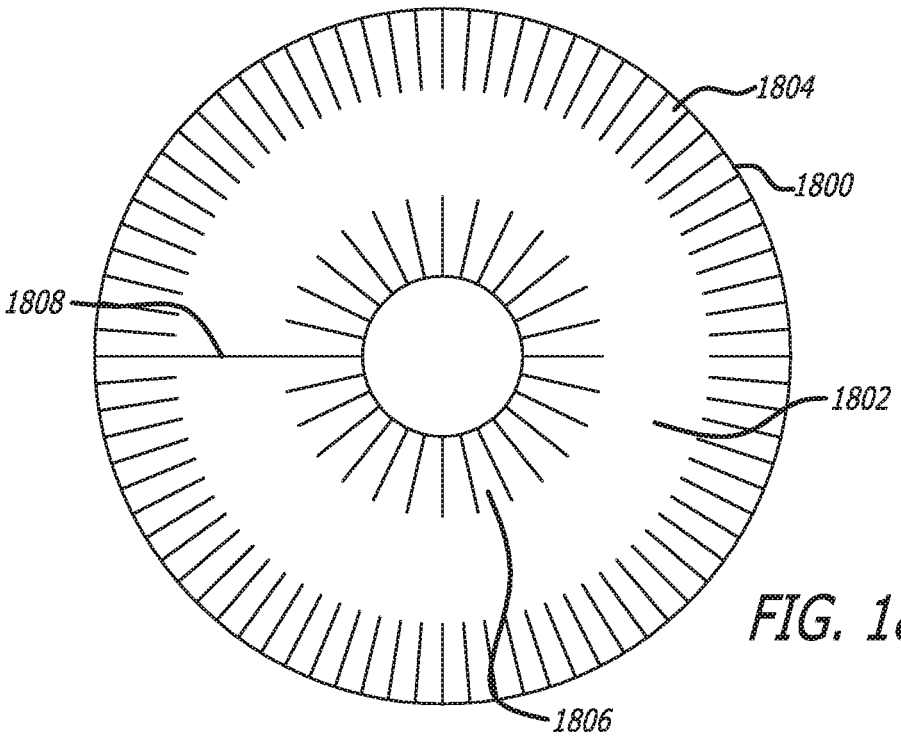
FIG. 18 illustrates a top view of a helical shaped parking structure floor with a single drive aisle, double loaded parking configuration.
Figure 19:
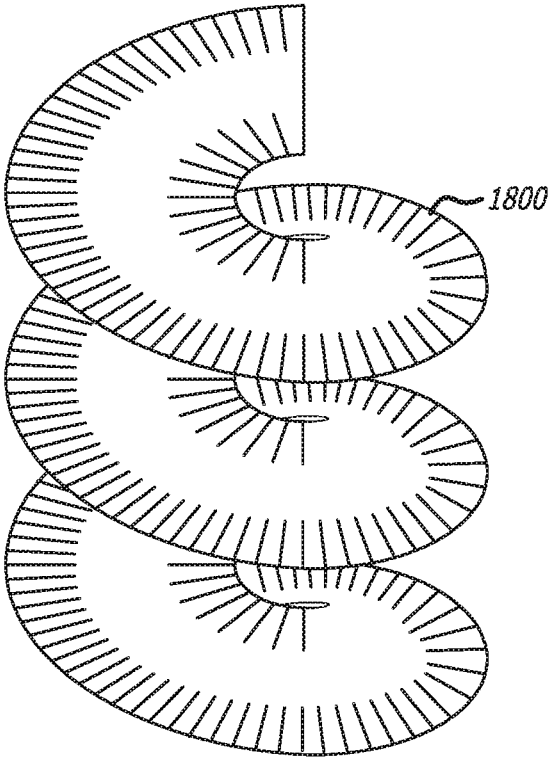
FIG. 19 illustrates a side view of a continuous helical shaped parking structure configuration.
Figure 20:
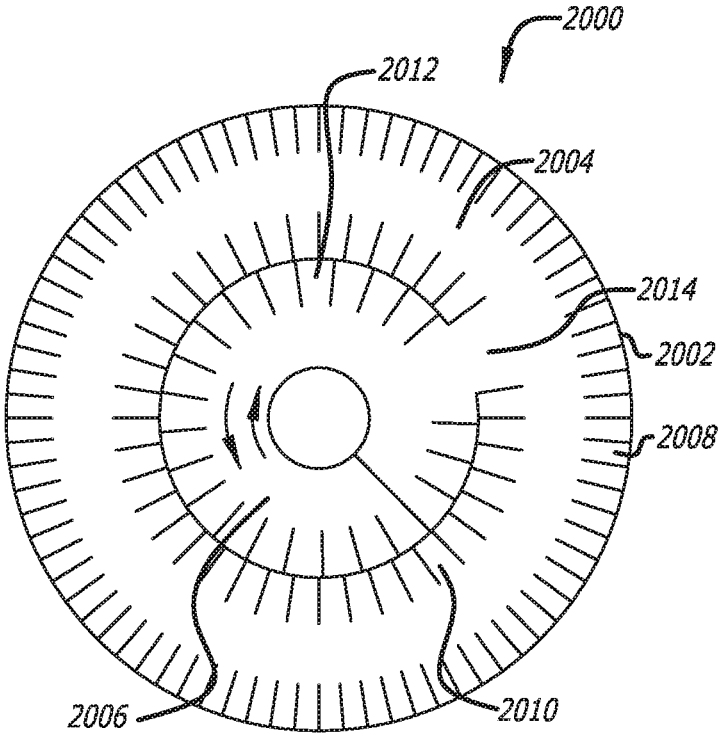
FIG. 20 illustrates a top view of a parking structure floor with a two drive aisle, inner helical shaped single loaded, outer flat double loaded parking configuration.

One configuration for underground parking structure 1700 having one or more deck 1702, wherein the radius of the underground structure is about 80 ft to 95 ft, is a single drive aisle with double loaded parking. Deck 1800, as depicted in FIG. 18, has single drive aisle 1802 with outer parking row 1804 and inner parking row 1806. In a single drive aisle with double loaded parking configuration, deck 1800 is continuous forming helical shaped (or spiral shaped) parking proceeding downwards (as illustrated in FIG. 19). A physical distinction between decks is illustrated by deck differentiator 1808.

A second configuration similar to a single drive aisle with double loaded parking structure configuration is a single drive aisle with single loaded parking configuration. Such a configuration of the underground structure has a radius of about 60 ft to 75 ft and has a single drive aisle with an outer parking row but no inner parking row. As in a single drive aisle with double loaded parking configuration, in a single drive aisle with single loaded parking configuration, the parking deck is continuous forming helical shaped parking proceeding downwards, similar that that illustrated in FIG. 19.

A third configuration is a two drive aisle, inner single loaded, outer double loaded configuration. Two drive aisle, inner single loaded, outer double loaded parking structure 2000 is appropriate for underground structures with a radius of about 110 ft to 165 ft, illustrated in FIG. 20. Two drive aisle, inner single loaded, outer double loaded parking deck 2002 has first drive aisle 2004 and second drive aisle 2006. First drive aisle 2004 has first outer parking row 2008 and outer drive aisle inner parking row 2010. Second drive aisle 2006 has second outer parking row 2012. First drive aisle 2004 comprises a deck of the parking structure. Second drive aisle 2006 is connected to first drive aisle 2004 by corridor 2014. Further, second drive aisle 2006 has a downward helical shaped deck similar to that illustrated in FIG. 19. Such a downward spiral shape deck allows automobiles to access one or more first drive aisles 2004 via corridor 2014.

Figure 21:
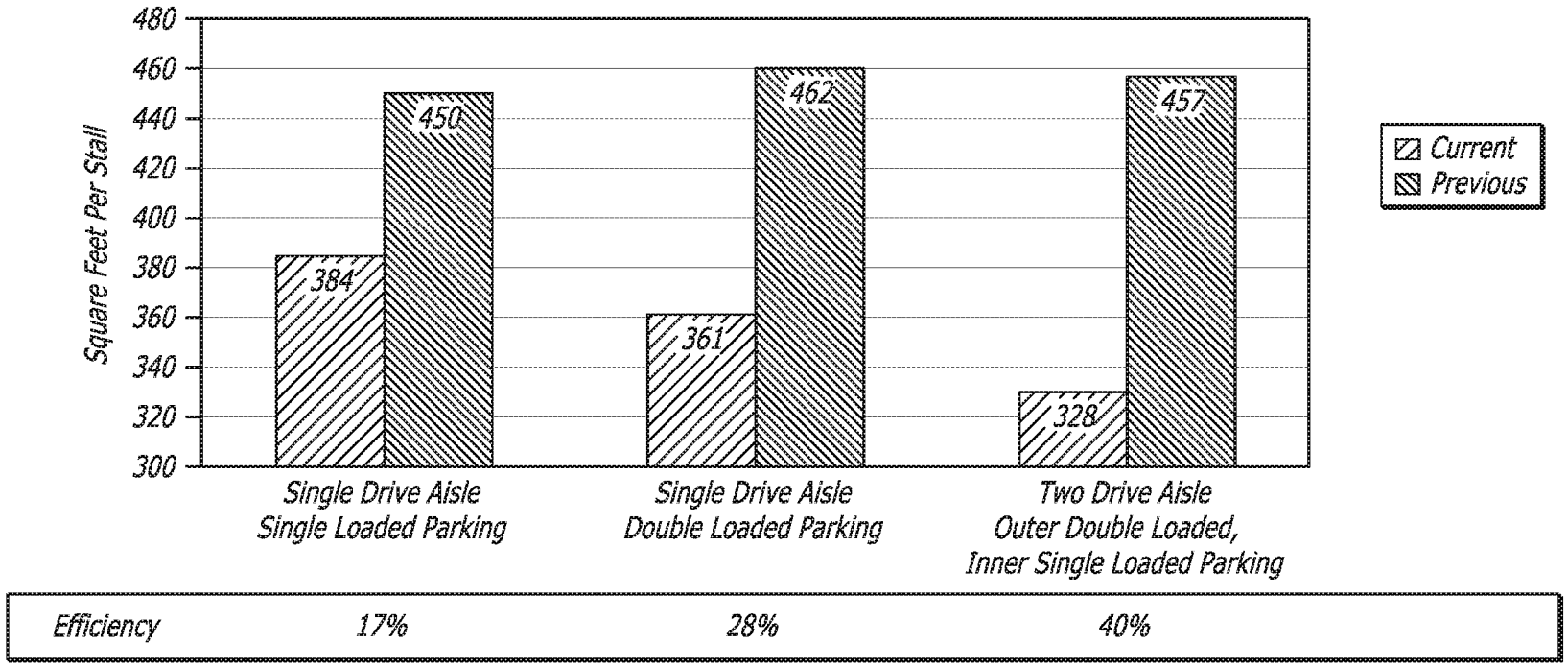
FIG. 21 graphically illustrates the efficiency square footage per stall when using the systems and methods of the present description compared to conventionally designed underground parking facilities.
Figure 22:
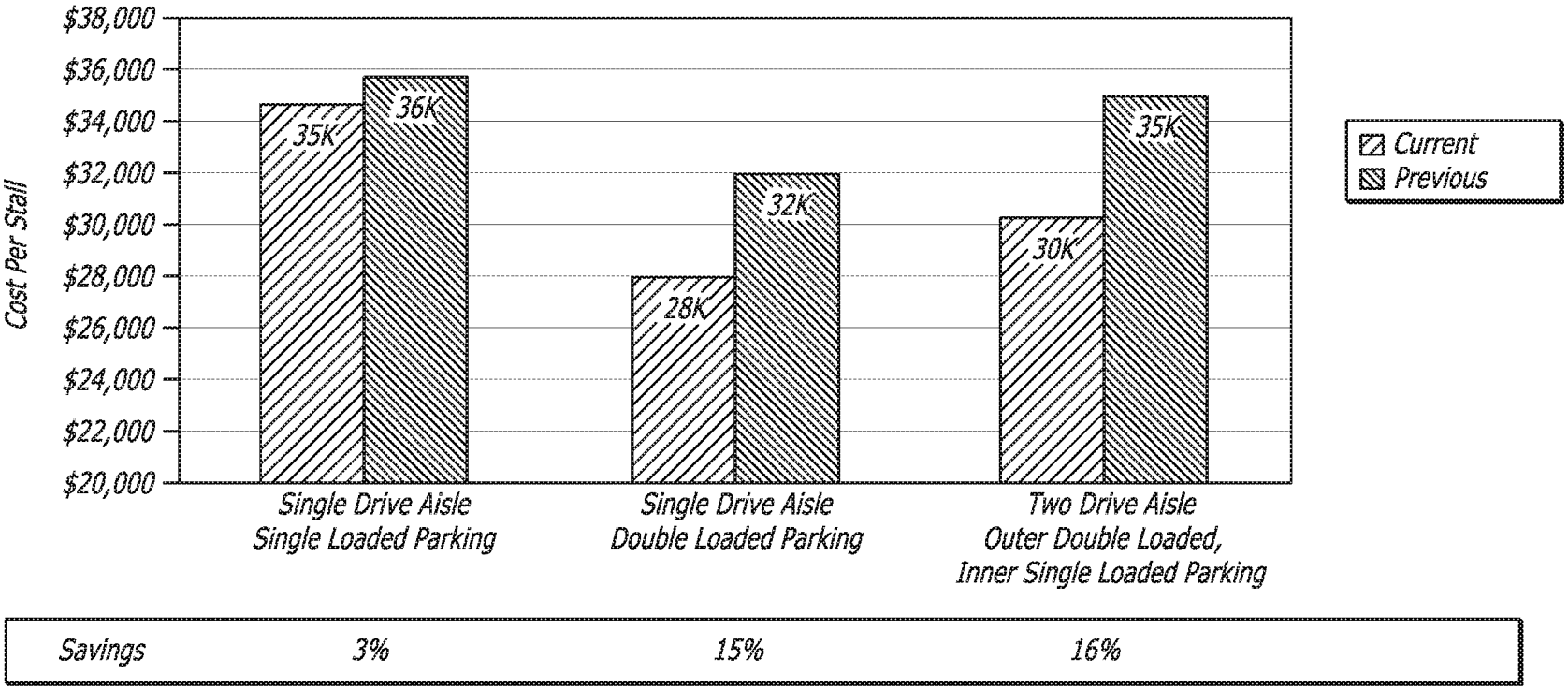
FIG. 22 graphically illustrates the savings in cost per stall when using the systems and methods of the present description compared to conventionally designed underground parking facilities.
Figure 23:
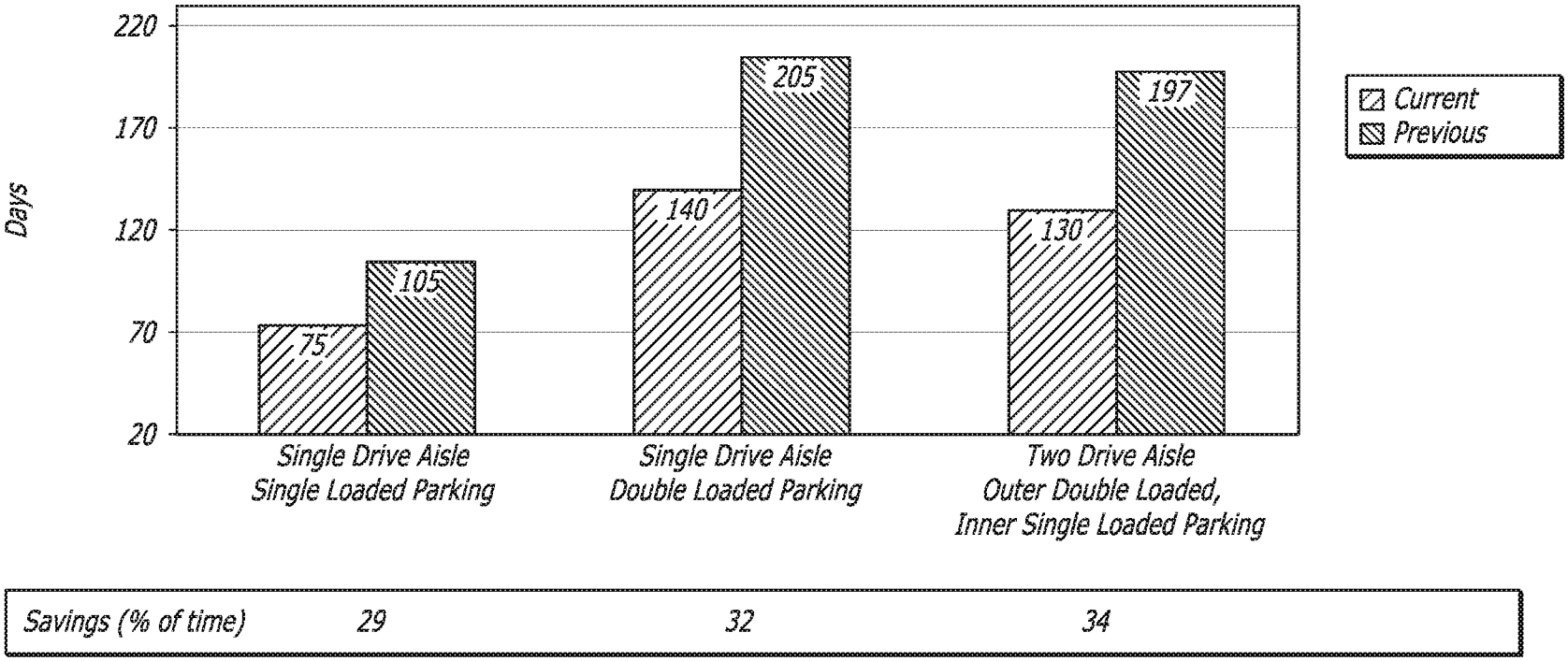
FIG. 23 graphically illustrates the savings in overall construction time when using the systems and methods of the present description compared to conventionally designed underground parking facilities.

The parking structure configurations described herein require less square feet per stall and cost less per stall when compared to a rectangular parking structure with a similar number of parking spaces. FIG. 21 graphically illustrates that all three configurations described above require less square footage per stall as compared to conventional rectangular shaped parking structures. The most efficient per square foot configuration, which is about 40% efficient, is two drive aisle, inner single loaded, outer double loaded. FIG. 22 graphically illustrates that the cost per stall of the parking structure configurations described above is lower than conventional rectangular structures of similar size. For example, the most savings per stall is in the two drive aisle, inner single loaded, outer double loaded configuration wherein about a 16% savings is realized. FIG. 23 graphically illustrates that the construction time of the parking structure configurations described above is less than conventional rectangular structures of similar size. For example, constructing a two drive aisle, inner single loaded, outer double loaded parking structure saves about 34% in time as compared to convention rectangular underground structures.

Example 4

Underground Storage

Embodiments of the present description are also well suited to a vast number of additional industrial, commercial, and residential applications. For example, industrial applications can include the storage of water, fuel or other liquids, storage of liquid propane, chlorine or other gaseous products. Such underground vertical structure embodiments may also serve as a secure structure to house utility stations (water, sewer, electric, etc.) and other spatial needs. Further, the present underground vertical structures are also well suited for use in the storage of household or business dry goods or for use as warehousing facilities.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification. Each of the above-cited references and printed publications are individually incorporated herein by reference in their entirety.

Specific embodiments disclosed herein may be further limited in the claims using consisting of or and consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

I claim:

1. A warehouse facility comprising:

a cylindrical structure including a plurality of segments forming horizontal rings stacked vertically and having a consistent inner diameter and a consistent outer diameter between a top horizontal ring and a bottom horizontal ring, at least one anchoring structure at or below the bottom horizontal ring; and one or more vertical post-tensioning cables configured to connect the at least one anchoring structure, extend through one or more segments, terminate at a location on or above the top horizontal ring, and reinforce the cylindrical structure.

2. The warehouse facility of claim 1, further comprising one or more horizontal post-tensioning cables configured to hold together the plurality of segments within a horizontal ring.

3. The warehouse facility of claim 1, further comprising one or more horizontal support members selected from one or more decks, one or more stiffener rings, or a combination thereof.

4. The warehouse facility of claim 1, wherein the plurality of segments comprise concrete segments.

5. The warehouse facility of claim 4, wherein the concrete segments include at least one vertical conduit configured to house the one or more vertical post-tensioning cables, at least one horizontal conduit configured to house one or more horizontal post-tensioning cables, or a combination thereof.

6. The warehouse facility of claim 1, further comprising one or more devices to hold together the horizontal rings stacked vertically.

7. The warehouse facility of claim 6, wherein the one or more devices to hold together the horizontal rings stacked vertically are bolts.

8. The warehouse facility of claim 1, wherein the cylindrical structure has a radius of between about 25 ft and about 200 ft.

9. The warehouse facility of claim 1, wherein the at least one anchoring structure is a foundation, a deck, a concrete anchor, the bottom horizontal ring, a tensioned anchor, or a combination thereof.

10. The warehouse facility of claim 1, wherein the cylindrical structure is configured to house automobiles, large items, liquid, gas, waste, containments, a utility station, or a combination thereof.

11. The warehouse facility of claim 10, wherein the liquid is water, fuel, or liquid propane.

12. A system for creating a warehouse facility comprising:

a plurality of segments used to fabricate a cylindrical structure including horizontal rings stacked vertically each formed from the plurality of segments, wherein the cylindrical structure has a consistent inner diameter and a consistent outer diameter between a top horizontal ring and a bottom horizontal ring; one or more materials to occupy the void between the vertically stacked horizontal rings; and one or more vertical post-tensioning cables configured to connect at least one anchoring structure, extend through one or more segments, terminate at a location on or above the cylindrical structure, and reinforce the cylindrical structure.

13. The system according to claim 12, further comprising one or more horizontal post-tensioning cables configured to hold together the plurality of segments within a horizontal ring.

14. The system according to claim 12, further comprising one or more horizontal support members selected from one or more decks, one or more stiffener rings, or a combination thereof.

15. The system according to claim 12, wherein the one or more horizontal rings comprise one or more key segments within the plurality of segments used to construct the one or more horizontal rings.

16. The system according to claim 12, wherein the plurality of segments comprises prefabricated concrete segments each including at least one vertical conduit configured to house the one or more vertical post-tensioning cables, at least one horizontal conduit configured to house one or more horizontal post-tensioning cables, or a combination thereof.

17. The system according to claim 12, wherein the cylindrical structure has a radius between about 25 ft and about 200 ft.

18. The system according to claim 12, wherein the at least one anchoring structure is a foundation, a deck, a concrete anchor, the bottom horizontal ring, a tensioned anchor, or a combination thereof.

19. The system according to claim 12, wherein the cylindrical structure is configured to house automobiles, large items, liquid, gas, waste, containments, a utility station, or a combination thereof.

20. The system according to claim 19, wherein the liquid is water, fuel, or liquid propane.

21. A warehouse facility comprising:

a cylindrical structure including a plurality of segments forming horizontal rings stacked vertically and having a consistent outer diameter and a consistent segment thickness between a top horizontal ring and a bottom horizontal ring, at least one anchoring structure at or below the bottom horizontal ring; and one or more vertical post-tensioning cables configured to connect the at least one anchoring structure, extend through one or more segments, terminate at a location on or above the top horizontal ring, and reinforce the cylindrical structure.

* * * * *